US010948841B2

(12) United States Patent
Otomo

(10) Patent No.: US 10,948,841 B2
(45) Date of Patent: Mar. 16, 2021

(54) IMAGE FORMING APPARATUS

(71) Applicant: Oki Data Corporation, Tokyo (JP)

(72) Inventor: Kohei Otomo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/353,036

(22) Filed: Mar. 14, 2019

(65) Prior Publication Data

US 2019/0302637 A1 Oct. 3, 2019

(30) Foreign Application Priority Data

Mar. 29, 2018 (JP) ..... JP2018-064394

(51) Int. Cl.
*G03G 15/01* (2006.01)
*G03G 15/02* (2006.01)

(52) U.S. Cl.
CPC ..... *G03G 15/0121* (2013.01); *G03G 15/0142* (2013.01); *G03G 15/0216* (2013.01)

(58) Field of Classification Search
CPC ..... G03G 15/0121; G03G 15/02; G03G 15/0225; G03G 15/0258
See application file for complete search history.

(56) References Cited

U.S. PATENT DOCUMENTS

2009/0047040 A1* 2/2009 Nieda ..... G03G 15/0194 399/167
2013/0084105 A1* 4/2013 Suzuki ..... G03G 15/0121 399/228

FOREIGN PATENT DOCUMENTS

JP 2013-073221 A 4/2013

* cited by examiner

*Primary Examiner* — Walter L Lindsay, Jr.
*Assistant Examiner* — Andrew V Do
(74) *Attorney, Agent, or Firm* — Muncy, Geissler, Olds & Lowe, P.C.

(57) ABSTRACT

An image forming apparatus includes an image forming section, a driving unit and an operation unit. The image forming section includes one or more image forming units. The driving unit generates driving force. The operation unit selectively performs a first operation and a second operation. The first operation is an operation to change over from a coupled state of the one or more image forming units and the driving unit, which the driving force is transmitted to the one or more image forming units, to a released state of the one or more image forming unit and the driving unit, which the driving force from the driving unit is not transmitted to the one or more image forming units. When the second operation is performed, the released state is maintained.

11 Claims, 19 Drawing Sheets

(MODE II)

(MODE I)

MODE II

MODE III

IMAGE FORMING APPARATUS

CROSS REFERENCE TO RELATED APPLICATIONS

This application claims priority under 35 USC 119 to Japanese Patent Application No. 2018-064394 filed on Mar. 29, 2018, the entire contents which are incorporated herein by reference.

TECHNICAL FIELD

The present technology relates to an image forming apparatus that forms an image by using an electrophotographic method.

BACKGROUND ART

Up to date, an image forming apparatus that provides with a developing roller and a coupling mechanism for connecting and disconnecting with a driving unit forming driving force for driving the developing roller has been proposed (see Japanese Patent Application Laid-Open (JP-A) No. 2013-073221, for example).

SUMMARY OF THE INVENTION

The technology relates to an image forming apparatus, which includes an image forming section, a driving unit and an operation unit. The image forming section includes one or more image forming units. The driving unit generates driving force. The operation unit selectively performs a first operation and a second operation. The first operation is an operation to change over from a coupled state of the one or more image forming units and the driving unit, where the driving force is transmitted to the one or more image forming units, to a released state of the one or more image forming unit and the driving unit, where the driving force from the driving unit is not transmitted to the one or more image forming units is blocked. When the second operation is performed, the released state is maintained.

DESCRIPTION OF THE EMBODIMENTS

Hereinafter, some example embodiments of the present technology will be described in detail with reference to the drawings. It is to be noted that the description below refers to mere specific examples of the technology, and the technology is therefore not limited thereto. Further, the technology is not limited to factors such as arrangements, dimensions, and dimension rations of the components illustrated in the respective drawings.

(1) First Example Embodiment

Figure 1:
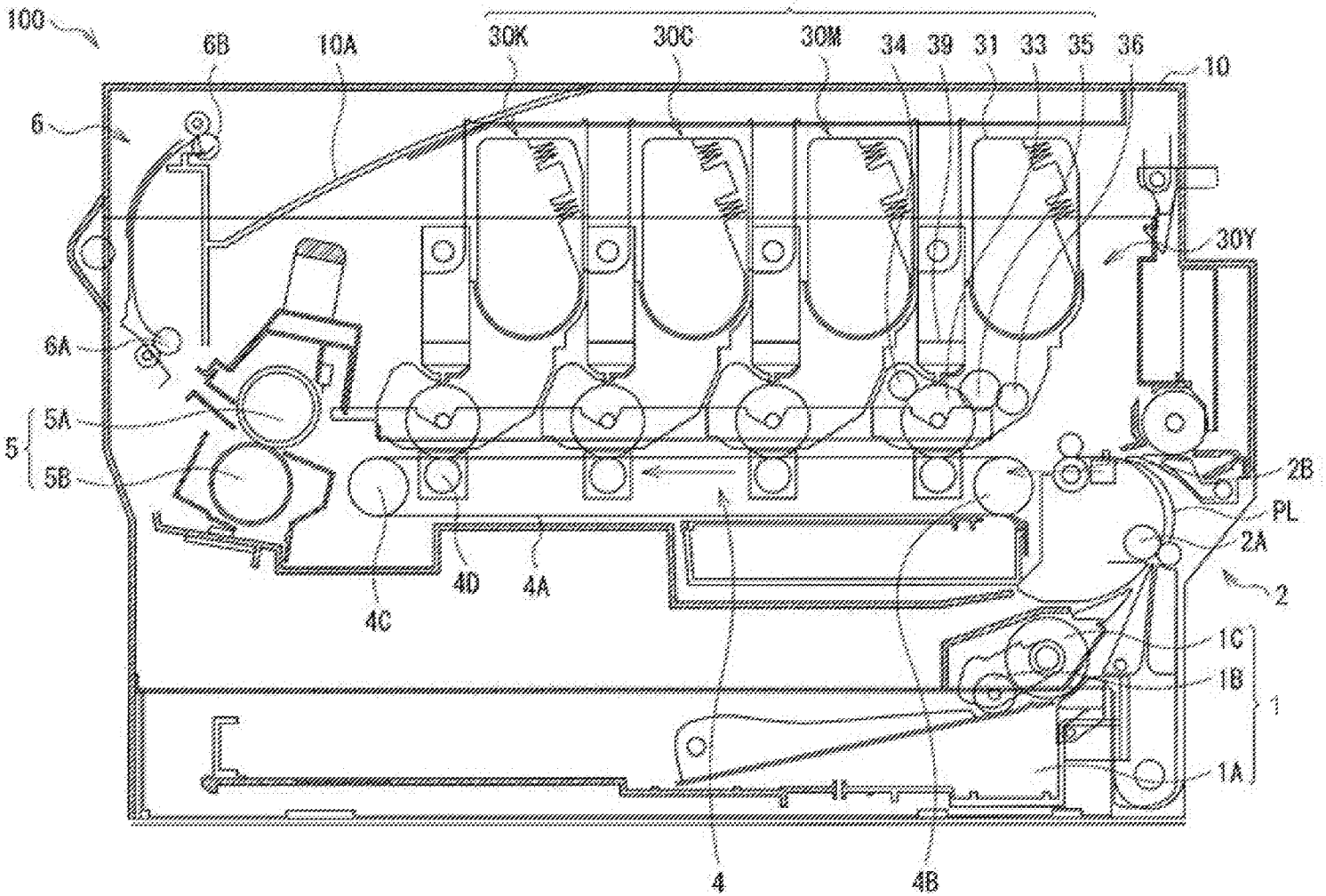
FIG. 1 is a schematic diagram illustrating an example of a general configuration of an image forming apparatus according to a first example embodiment in the technology.

FIG. 1 is a schematic diagram illustrating an example of a general configuration of an image forming apparatus 100 according to one embodiment of the technology. As illustrated in FIG. 1, the image forming apparatus 100 includes, inside a casing 10, a medium feeding section 1, a conveyance section 2, an image forming section 3, a transferring section 4, a fixing section 5 and an ejecting section 6. The image forming apparatus 100 may be an electrophotography printer that forms an image (a color image, for example) on a medium PM (also called a print medium or a transfer material) such as a sheet of paper, and corresponds to a specific example of the "image forming apparatus" of this technology. The entire shapes and dimensions of the image forming apparatus 100 illustrated in FIG. 1 or the shapes, dimensions, and arrangement positions of the respective components included in the image forming apparatus 100 are examples, and the "image forming apparatus" of the technology is not limited to this. Further, the shapes, dimensions, arrangement positions, and the like of the components included in the image forming apparatus 100 illustrated in FIG. 1 may not match the shapes, dimensions, arrangement positions, and the like of the respective components illustrated in FIG. 2 and the subsequent drawings.

Figure 2A:
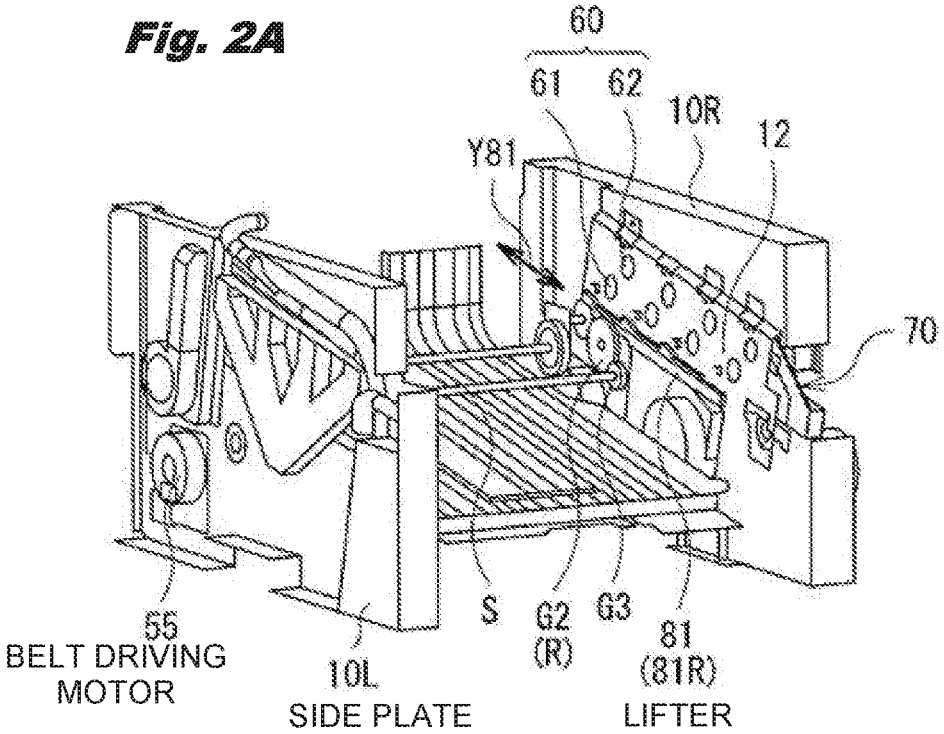
FIG. 2A is a perspective view illustrating a configuration example of side plates of a casing illustrated in FIG. 1.
Figure 2B:
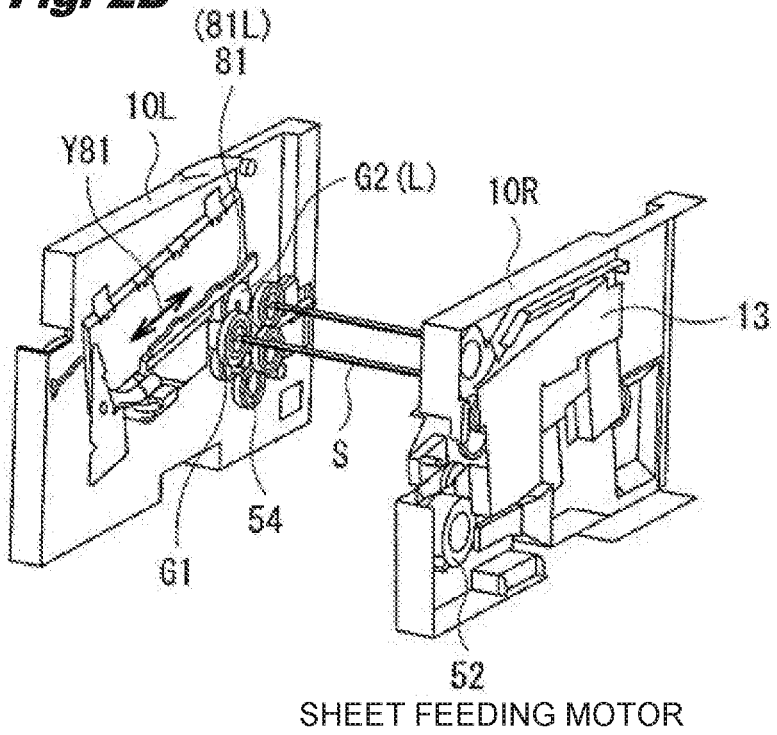
FIG. 2B is another perspective view illustrating a configuration example of side plates of the casing illustrated in FIG. 1.

FIG. 2A and FIG. 2B are a perspective view illustrating a configuration example of a part of the casing 10 illustrated in FIG. 1 and its vicinity. As illustrated in FIG. 2A and FIG. 2B, the casing 10 includes a side plate 10L and a side plate 10R. The side plate 10L and the side plate 10R are erect so as to oppose to each other. The medium feeding section 1, the conveyance section 2, the image forming section 3, the transferring section 4, the fixing section 5, and an ejecting section 6 are arranged between the side plate 10L and the side plate 10R. As illustrated in FIG. 2A and FIG. 2B, the side plate 10L and the side plate 10R are provided with a lifter 81L and a lifter 81R, respectively. In the following description, the lifter 81L and the lifter 81R may be collectively referred to as "lifter 81". Further, a driving force transmission unit 60 and a movable unit 70 are provided on the side plate 10R. Further, a cover 12 that covers the driving force transmission unit 60 and the movable unit 70 is provided on a surface of the side plate 10R facing the side plate 10L. A cover 13 that covers the driving force transmission unit 60 and the movable unit 70 is provided on a surface of the side plate 10R in opposite to the side plate 10L. Further, a gear G2(R) that meshes with a gear portion 85 of the lifter 81R, a gear G3 that meshes with the gear G2(R), and a sheet feeding motor 52 are provided in the downward of the lifter 81R. On the other hand, the gear G2(L) that meshes with a gear portion of the lifter 81L, a gear G1 that meshes with the gear G2(L), a belt driving motor 55 and a second clutch 54 are provided in the downward of the lifter 81L. Further, a shaft S that rotates integrally with the gear G3 and the gear G1 is provided while holding the gear G3 at one end and holding the gear G1 at the other end. The driving force transmission unit 60, the movable unit 70, the lifter 81L and the lifter 81R will be described in detail later.

In specification, the term "conveyance path PL" (FIG. 1) may refer to a path along which the medium PM is to be conveyed. The term "upstream" may refer to a position, in the conveyance path PL, that is in a direction toward the medium feeding section 1 or is closer to the medium feeding section 1 compared with a certain component that may be any of components of the image forming apparatus. The term "downstream" may refer to a position, in the conveyance path PL, that is in a direction opposite to the direction toward the medium feeding section 1 or is farther from the medium feeding section 1 compared with a certain component that may be any of components of the image forming apparatus. The term "conveyance direction" may refer to a direction in which the medium PM proceeds along the conveyance path, i.e., a direction from the upstream toward the downstream. The term "width direction" may refer to a direction that is parallel to the medium PM conveyed along the conveyance path PL and is orthogonal to the conveyance direction. The width direction may be an X-axis direction illustrated in FIG. 1, for example. The term "length" may refer to a dimension in the conveyance direction. The term "width" may refer to a dimension in the width direction.

The medium feeding section 1 feeds the medium PM one by one to the conveyance section 2. The medium feeding section 1 includes, for example, a container tray 1A that contains the medium PM, a sheet feeding roller 1B, and a conveyance roller 1C. The container tray 1A contains a plurality of media PM in a stacked manner. For example, the container tray 1A is detachably attached to a lower part of the image forming apparatus 100. The sheet feeding roller 1B and the conveyance roller 1C sequentially allow the media PM contained in the container tray 1A to be fed to the conveyance path PL that leads to the conveyance section 2. The sheet feeding roller 1B and the conveyance roller 1C rotate in a direction in which the medium PM is fed toward the conveyance section 2 that is located downstream of the sheet feeding roller 1B and the conveyance roller 1C. The sheet feeding roller 1B rotates by receiving driving force from a sheet feeding motor 52 of a driving unit 50 driven based on the control of a controller 20. The sheet feeding roller 1B is arranged at a position so as to make contact with an upper surface of the medium PM on the top of the stacked media PM. The conveyance roller 1C is arranged downstream of the sheet feeding roller 1B.

The conveyance section 2 conveys the medium PM fed from the medium feeding section 1 to the transferring section 4 while controlling a skew of the medium PM. The conveyance section 2 includes, for example, a pair of conveyance rollers 2A and a pair of conveyance rollers 2B.

The image forming section 3 forms a toner image on the medium PM conveyed from the conveyance section 2 (see, FIG. 2). As illustrated in FIG. 1, the image forming section 3 includes four image forming units, i.e., image forming units 30Y, 30M, 30C, and 30K, for example. The image forming units 30Y, 30M, 30C, and 30K each forms the toner image, i.e., an image, of a corresponding color by means of a toner of the corresponding color. Specifically, the image forming units 30Y, 30M, 30C, and 30K form the toner images of yellow, magenta, cyan, and black, by means of a yellow toner, a magenta toner, a cyan toner, and a black toner, respectively. In the image forming section 3, the image forming unit 30Y, the image forming unit 30M, the image forming unit 30C, and the image forming unit 30K are arranged in order in the conveyance direction from the upstream toward the downstream, for example. It is to be noted that, herein, four image forming units 30Y, 30M, 30C, and 30K may be collectively referred to as an "image forming unit 30" in a case where four image forming units 30Y, 30M, 30C, and 30K are not differentiated from each other. The image forming unit 30 may correspond to an "one or more image forming units" according to one specific but non-limiting embodiment of the technology. The detailed structure of the image forming unit 30 will be described later.

The transferring section 4 may be also referred to as a transfer belt unit. The transferring section 4 includes a transfer belt 4A, a driving roller 4B, an idle roller 4C, and a transferring roller 4D. The driving roller 4B drives the transfer belt 4A. The idle roller 4C is driven in accordance with the driving roller 4B. The transferring roller 4D is arranged to face a photosensitive drum 33 with the transfer belt 4A in between. The driving roller 4B and the idle roller 4C each are a substantially-cylindrical member that is rotatable around a rotation shaft. The rotation shaft extends in the width direction (X axis direction). The transferring section 4 is a mechanism that conveys, in the conveyance direction, the medium PM conveyed from the conveyance section 2, and sequentially transfers, onto the surface of the medium PM, the toner images formed by the respective image forming units 30Y, 30M, 30C, and 30K.

The transfer belt 4A is an endless elastic belt that is made of a resin material such as polyimide resin, for example. The transferring belt 4A is stretched by the driving roller 4B and the idle roller 4C. In other words, the transfer belt 4A may lie from the driving roller 4B to the idle roller 4C while being stretched. The driving roller 4B receives driving force from the belt driving motor 55 of the driving unit 50 and driven to rotate in a direction in which the medium PM is conveyed, on the basis of the control performed by the controller 20. The driving roller 4B causes the transfer belt 4A to rotate circularly. The driving roller 4B is arranged upstream of the image forming units 30Y, 30M, 30C, and 30K. The idle roller 4C adjusts tension applied to the transfer belt 4A by means of urging force provided by an urging member. The idle roller 4C rotates in a direction same as the rotation direction of the driving roller 4B. The idle roller 4C is arranged downstream of the image forming units 30Y, 30M, 30C, and 30K.

The transfer roller 4D electrostatically transfers, onto the medium PM, the toner images formed by the respective image forming units 30Y, 30M, 30C, and 30K while conveying the medium PM in the conveyance direction by rotating in a direction opposite to the rotation direction of the photosensitive drum 33. The transfer roller 4D includes a metal shaft and a foamed electrically-semiconductive elastic rubber material that covers an outer circumference surface of the metal shaft, for example.

The fixing section 5 applies heat and pressure to the toner image on the medium PM that has passed the transferring section 4, thereby fixing the toner image onto the medium PM. The fixing section 5 includes an upper roller 5A and a lower roller 5B, for example.

Either the upper roller 5A or the lower roller 5B includes a heater as a heat source inside of either the upper roller 5A or the lower roller 5B, and serves as a heating roller that applies heat to the toner image formed on the medium PM. Non-limiting examples of the heater may include a halogen lamp. The upper roller 5A receives driving force from a fixing motor 56 of the driving unit 50 and rotates in a direction in which the medium PM is conveyed, on the basis of the control performed by the controller 20. The heat source provided on at least one of the upper roller 5A or the lower roller 5B receive a bias voltage, and thereby control the surface temperature of the corresponding one of the upper roller 5A or the lower roller 5B. The lower roller 5B is arranged to face the upper roller 5A so that a pressure-contact portion is formed between the upper roller 5A and the lower roller 5B. The lower roller 5B serves as a pressure-applying roller that applies pressure to the toner image on the medium PM. The lower roller 5B may include a surface layer including an elastic material.

The ejecting section 6 ejects, to the outside, the medium PM to which the toner image is fixed by the fixing section 5. The ejecting section 6 includes a pair of conveyance rollers 6A and a pair of conveyance rollers 6B, for example. The pair of conveyance rollers 6A and the pair of conveyance roller 6B cause the medium PM to be ejected to the outside through the conveyance path PL and cause an external stacker 10A to be stocked with the ejected medium PM. The pair of conveyance roller 6A and the pair of conveyance roller 6B perform a rotation operation in a direction in which the medium PM is conveyed in the conveyance direction.

Figure 3:
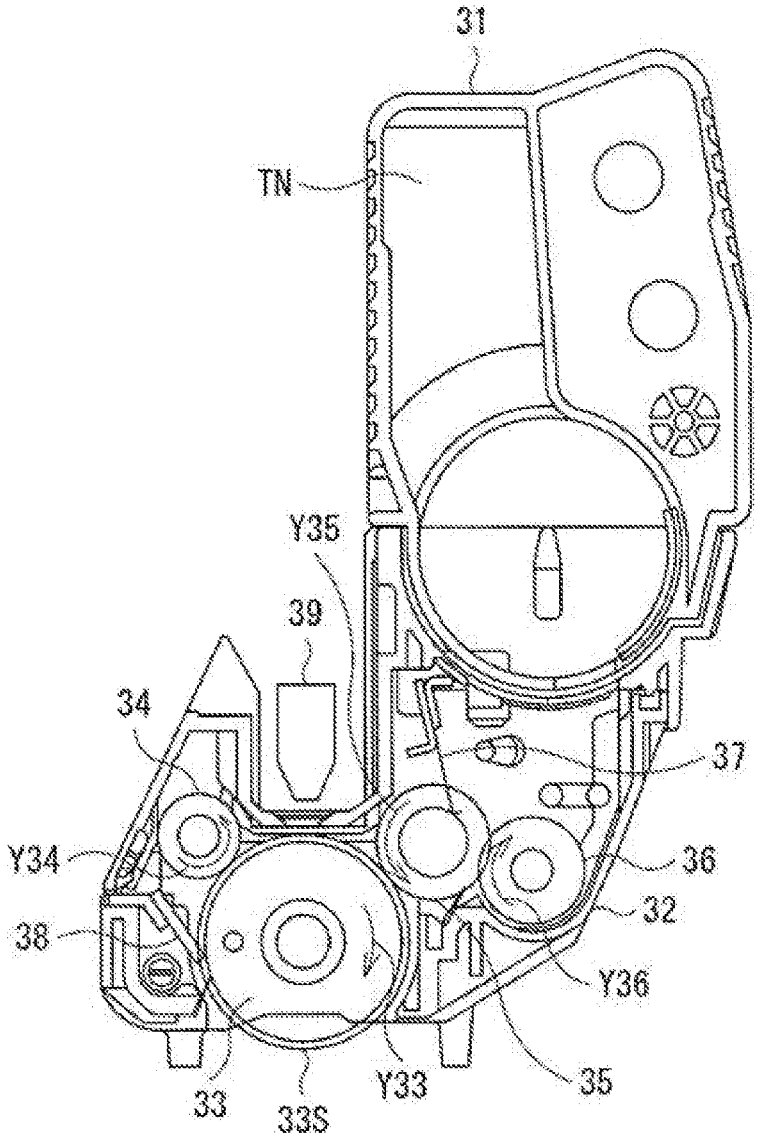
FIG. 3 is a schematic diagram illustrating a configuration example of an image forming unit provided in the image forming apparatus illustrated in FIG. 1.

FIG. 3 is a schematic diagram illustrating a schematic configuration example of each of the image forming units 30 according to one embodiment of the technology. As illustrated in FIG. 3, each of the image forming units 30 includes a toner cartridge 31 and an image forming cartridge 32.

As illustrated in FIG. 3, the toner cartridge 31 is a container in which a toner TN of a predetermined color is stored inside of the toner cartridge 31. The image forming cartridge 32 performs an image forming by using the toner TN supplied from the toner cartridge 31. The toner TN is configured by non-magnetic materials including a binder resin; a charge control agent, a release agent, and a colorant that serve as internal additives; and an external additive. The binder resin may be, for example but not limited to, a polyester resin. The external additive may be, for example but not limited to, silica or a titanium oxide. Among these materials, a color of the colorant may be selected on an as-needed basis to change a color of the toner image to be formed by each of the image forming units 30.

As illustrated in FIG. 3, the image forming cartridge 32 includes, inside of the image forming cartridge 32, the photosensitive drum 33, a charging roller 34, a developing roller 35, a feeding roller 36, a toner regulatory blade 37, a cleaning blade 38, and the like.

The photosensitive drum 33 is a cylindrical member in which a photoreceptor (for example, an organic photoreceptor) capable of supporting an electrostatic latent image covers a surface of the photosensitive drum 33. Specifically, the photosensitive drum 33 includes an electrically-conductive supporting body and a photosensitive layer 33S, i.e., a photoconductive layer, that covers a circumferential part, i.e., a surface, of the electrically-conductive supporting body. The electrically-conductive supporting body includes a metal pipe made of aluminum, for example. The photoconductive layer 33S has a structure including an electric charge generation layer and an electric charge transfer layer that are stacked in order, for example. The photosensitive drum 33 receives driving force from an image drum motor 53 (hereinafter, an ID motor) of the driving unit 50 and performs a rotation operation at a predetermined circumferential velocity in a direction in which the medium PM is conveyed, i.e., a rotation direction Y33, on the basis of the control performed by the controller 20.

The charging roller 34 is a charging member that electrically charges the photosensitive layer 33S of the photosensitive drum 33. The charging roller 34 is arranged so as to be in contact with the photosensitive layer 33S of the photosensitive drum 33. The charging roller 34 includes a metal shaft and an electrically-semiconductive rubber layer that covers an outer circumferential part of the metal shaft, for example. Non-limiting examples of the electrically-semiconductive rubber layer may include an electrically-semiconductive epichlorohydrin rubber layer. The charging roller 34 receives driving force from the ID motor 53 of the driving unit 50 and performs a rotation operation, for example, in a rotation direction Y34 opposite to the rotation direction Y33 of the photosensitive drum 33, on the basis of the control performed by the controller 20.

The developing roller 35 is a member that has a surface supporting the toner TN that develops the electrostatic latent image. The developing roller 35 is arranged so as to be in contact with the photosensitive layer 33S of the photosensitive drum 33. The developing roller 35 includes a metal shaft and an electrically-semiconductive urethane rubber layer that covers an outer circumferential part of the metal shaft, for example. The developing roller 35 receives driving force from the ID motor 53 of the driving unit 50 and performs a rotation operation at a predetermined circumferential velocity in a rotation direction Y35 opposite to the rotation direction Y33 of the photosensitive drum 33, on the basis of the control performed by the controller 20.

The feeding roller 36 is a feeding member that feeds the toner TN to the developing roller 35. The feeding roller 36 is arranged so as to be in contact with a surface, i.e., a circumferential surface, of the developing roller 35. The feeding roller 36 includes a metal shaft and a foamed silicone rubber layer that covers an outer circumferential part of the metal shaft, for example. The feeding roller 36 receives driving force from the ID motor 53 of the driving unit 50 and performs a rotation operation in a rotation direction Y36 opposite to the rotation direction Y35 of the developing roller 35, on the basis of the control performed by the controller 20.

The toner regulatory blade 37 forms a layer made of the toner TN (a toner layer) on the surface of the rotating developing roller 35 and also regulates a thickness of the toner layer and an amount by which the toner is attached to the surface of the developing roller 35. The toner regulatory blade 37 is, for example, a plate-shaped elastic member (e.g. a leaf spring) made of stainless steel or the like. A bending portion in the vicinity of a tip end portion of the plate-shaped elastic member of the toner regulatory blade 37 is arranged so as to be slightly in contact with the surface of the developing roller 35.

The cleaning blade 38 scrapes the toner TN remained on the surface of the photosensitive layer 33S of the photosensitive drum 33. The cleaning blade 38 is configured to include a material such as a flexible rubber material and a flexible plastic material.

Outside the image forming cartridge 32, an exposure device 39 is provided so as to be able to perform exposure on the photosensitive drum 33. The exposure device 39 includes, for example, an exposure head including a light emitting diode (LED) or the like. The exposure device 39 forms the electrostatic latent image on the photosensitive layer 33S of the photosensitive drum 33 by exposing the photosensitive layer 33S of the photosensitive drum 33. The exposure device 39 includes a plurality of light emitters for each of the photosensitive drums 33. The light emitters are arranged side by side in the width direction of the exposure device 39. Each of the light emitters includes a light source that emits application light, and a lens array that performs imaging of the application light on the surface of the photosensitive layer 33S, for example. The light source that emits the application light may be an LED, for example.

Figure 4:
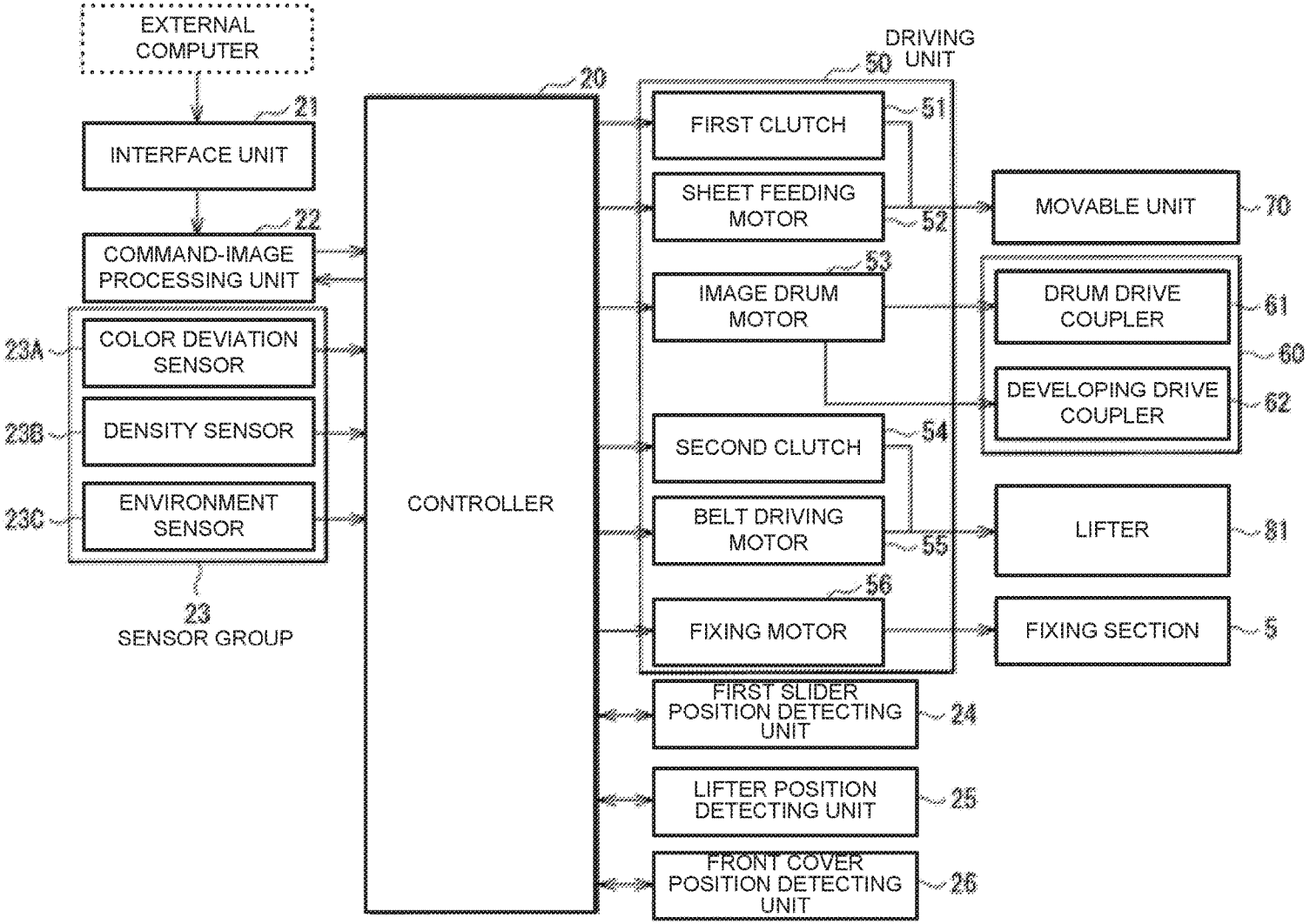
FIG. 4 is a block diagram schematically illustrating a configuration example of a control mechanism of the image forming apparatus illustrated in FIG. 1.

Next, a control mechanism of the image forming apparatus 100 will be described by mainly referring to FIG. 4. FIG. 4 is a block diagram schematically illustrating a configuration example of the control mechanism in the image forming apparatus illustrated in FIG. 1. As illustrated in FIG. 4, the image forming apparatus 100 includes, as the control mechanism of the image forming apparatus 100, a controller 20, an interface unit 21, a command image-processing unit 22, a sensor group 23, a first slider position detecting unit 24, a lifter position detecting unit 25 and a front cover position detecting unit 26. The interface unit 21 receives a printing data or a control command from an external device such as a computer, and transmits to the command image-processing unit 22. The command-image processing unit 22 receives a printing data or a control command from the interface unit 21, performs image processing, and transmits to the controller 20. For example, the sensor group 23 includes a color deviation sensor 23A, a density sensor 23B and an environment sensor 23C. Each of the color deviation sensor 23A, the density sensor 23B and the environment sensor 23C transmits detected information to the controller 20. The first slider position detecting unit 24 detects a position of a first slider 71 and transmits detected information to the controller 20. The lifter position detecting unit 25 detects a position of a lifter 81 and transmits detected information to the controller 20. Further, the front cover position detecting unit 26 detects a position of a front cover 11 and transmits detected information to the controller 20. The first slider position detecting unit 24, the lifter position detecting unit 25 and the front cover position detecting unit 26 may be, for example, an optical sensor, a touch sensor, or the like.

The image forming apparatus 100 further includes the driving unit 50, the driving force transmission unit 60, the movable unit 70 and the lifter 81. The controller 20 includes a random access memory (RAM), a read only memory (ROM), a central processing unit (CPU), or the like. The controller 20 controls the operation control of the driving unit 50 based on information from the first slider position detecting unit 24, the lifter position detecting unit 25, the front cover position detecting unit 26, or the like, in addition to the information from the sensor group 23.

The driving unit 50 includes a first clutch 51, a sheet feeding motor 52, the ID motor 53, a second clutch 54, the belt driving motor 55 and the fixing motor 56. The first clutch 51 is a member that forms driving force transmission path connecting the sheet feeding motor 52 and the first slider 71. The sheet feeding motor 52 is a driving source to rotate the sheet feeding roller 1B of the conveyance section 2, on the basis of the control performed by the controller 20. The sheet feeding motor 52 is connected to the first slider 71 of the movable unit 70 by the first clutch 51 and also functions as a driving source to be slid the first slider 71, on the basis of the control performed by the controller 20. The ID motor 53 is a driving source to be rotated the photosensitive drum 33 and the developing roller 35 of each of the image forming units 30 via the driving force transmission unit 60. The second clutch 54 is a member that forms driving force transmission path connecting the belt driving motor 55 and the lifter 81. The belt driving motor 55 is a driving source to rotate the driving roller 4B (the transfer belt 4A) of the transferring section 4, on the basis of the control performed by the controller 20. The belt driving motor 55 is connected to the lifter 81 by the second clutch 54 and also functions as a driving source to be slid the lifter 81, on the basis of the control performed by the controller 20. The fixing motor 56 is a driving source to rotate the upper roller 5A of the fixing section 5, on the basis of the control performed by the controller 20. The driving unit 50 corresponds to one specific example of "driving unit" in the technology.

The driving force transmission unit 60 includes a plurality of drum drive couplers 61 and a plurality of developing drive couplers 62. Each of the drum drive couplers 61 couples with both the ID motor 53 and the photosensitive drum 33, thereby forming a coupled state between the ID motor 53 and the photosensitive drum 33. In the coupled state of the ID motor 53 and the photosensitive drum 33, driving force of the ID motor 53 is able to transmit to the photosensitive drum 33. On the other hand, each of the drum drive couplers 61 uncouples from at least one of the ID motor 53 and the photosensitive drum 33, thereby forming a released state (uncoupled state) between the ID motor 53 and the photosensitive drum 33. In the released state of the ID motor 53 and the photosensitive drum 33, the driving force from the ID motor 53 is not transmitted to the photosensitive drum 33 is blocked. Each of the developing drive couplers 62 couples with both the ID motor 53 and the developing roller 35, thereby forming the coupled state between the ID motor 53 and the developing roller 35. In the coupled state of the ID motor 53 and the developing roller 35, driving force of the ID motor 53 is able to transmit to the developing roller 35. On the other hand, each of the developing drive couplers 62 uncouples from at least one of the ID motor 53 and the developing roller 35, thereby forming the released state between the ID motor 53 and the developing roller 35. In the released state of the ID motor 53 and the developing roller 35, the driving force from the ID motor 53 is not transmitted to the developing roller 35.

Figure 5A:
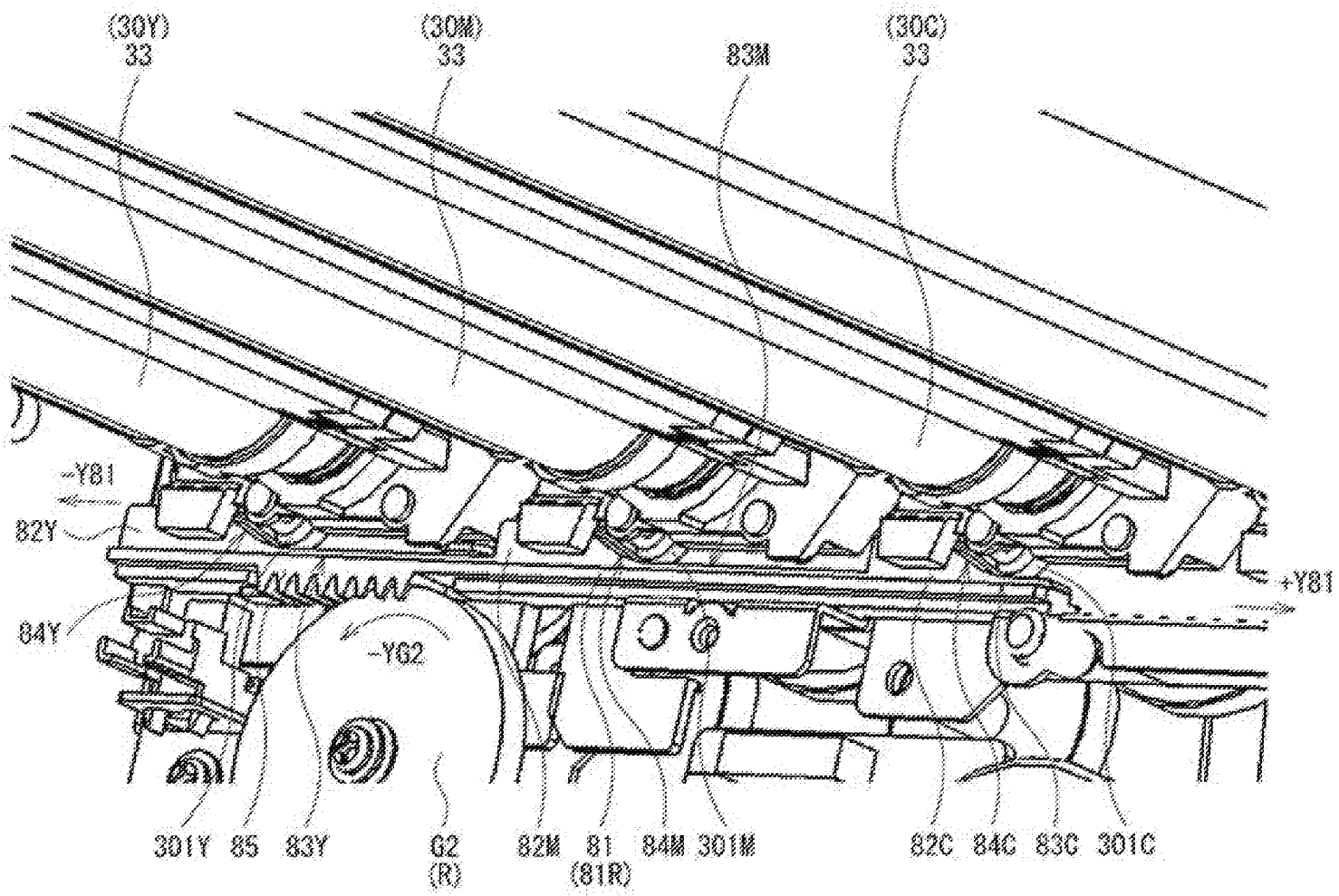
FIG. 5A is an enlarged perspective view illustrating the vicinity of a contacting portion of side plates of the casing and the image forming unit, in a color printing mode.
Figure 5B:
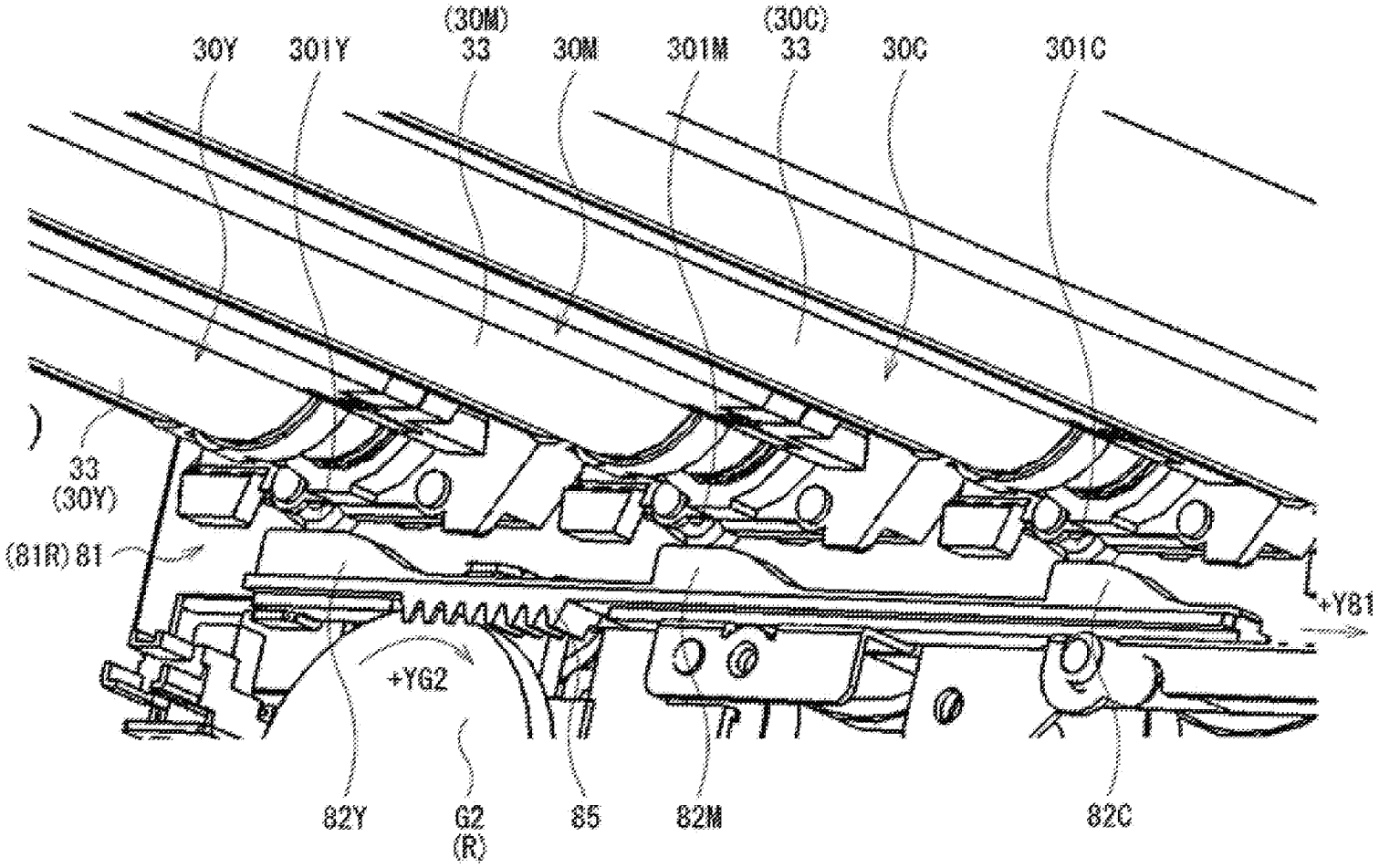
FIG. 5B is an enlarged perspective view illustrating the vicinity of the contacting portion of side plates of the casing and the image forming unit, in a monochrome printing mode.

As described above, the lifter 81L is provided on the side plate 10L, and the lifter 81R is provided on the side plate 10R (FIG. 2A and FIG. 2B). The lifter 81L and the lifter 81R are members which support the image forming units 30Y, 30M and 30C among the image forming section 3. The lifter 81L and the lifter 81R support the image forming units 30Y, 30M and 30C from downward at both ends of thereof. The lifter 81L and the lifter 81R are reversibly slidable in the direction of the arrow Y81 which is the longitudinal direction of each lifter. The lifter 81L and the lifter 81R slide in the direction of the arrow Y81, and therefore the image forming units 30Y, 30M and 30C can move upward of or downward. FIG. 5A and FIG. 5B are enlarged perspective views illustrating the lifter 81R and the vicinity of the lifter 81R. An upper end of the lifter 81R contacts a contacting portion 301Y positioning at a lower part of the image forming unit 30Y, a contacting portion 301M positioning at a lower part of the image forming unit 30M and a contacting portion 301C positioning at a lower part of the image forming unit 30C, thereby supporting the image forming units 30Y, 30M and 30C. The lifter 81L supports, like the lifter 81R, the image forming units 30Y, 30M and 30C, at the opposite end to the lifter 81R with respect to the image forming units 30Y, 30M and 30C. FIG. 5A illustrates the positional relationship between the image forming units 30Y, 30M and 30C and the lifter 81R, in a color printing mode. FIG. 5B illustrates the positional relationship between the image forming units 30Y, 30M and 30C and the lifter 81R, in a monochrome printing mode.

The lifter 81L and the lifter 81R are assumed to be line symmetrical relationship relates to shapes, sizes and arrangement positions. The lifter 81R will be described with reference to FIG. 5A and FIG. 5B. The lifter 81R is a member extending along a direction in which the image forming unit 30Y, the image forming unit 30M and the image forming unit 30C are arranged in order. The lifter 81R includes a convex portion 82Y projecting toward the image forming unit 30Y, a convex portion 82M projecting toward the image forming unit 30M and a convex portion 82C projecting toward the image forming unit 30C. In addition, the lifter 81R further includes a concave portion 83Y, a concave portion 83M and a concave portion 83C. The concave portion 83Y is positioned between the convex portion 82Y and the convex portion 82M. The concave portion 83M is positioned between the convex portion 82M and the convex portion 82C. The concave portion 83C is positioned in opposite side to the concave portion 83M, when viewed from the convex portion 82C. A slope 84Y is provided between the convex portion 82Y and the concave portion 83Y. A slope 84M is provided between the convex portion 82M and the concave portion 83M. A slope 84C is provided between the convex portion 82 C and the concave portion 83C. Further, the gear portion 85 that meshes with a gear portion of the gear G2 is provided in the downward of the lifter 81R. The lifter 81R advances straight in the +Y81 direction as the gear G2 rotates in the +YG2 direction, for example. The lifter 81R advances straight in the −Y82 direction as the gear G2 rotates in the −YG2 direction. In image forming apparatus 100, the lifter 81R moves straight in a +Y81 direction from a position corresponding to the color printing mode in FIG. 5A in association with the rotation operation of the gear G2, thereby switching to the monochrome printing mode in FIG. 5B. In contrast, the lifter 81R moves straight in a −Y81 direction from a position corresponding to the monochrome printing mode in FIG. 5B in association with the rotation operation of the gear G2, thereby switching to the color printing mode in FIG. 5A.

As illustrated in FIG. 5A, in the color printing mode, the contacting portions 301Y, 301M and 301C contact upper end surfaces of the concave portions 83Y, 83M and 83C, respectively. That is, in the color printing mode, the image forming units 30Y, 30M and 30C shift downward, thereby approaching the transfer roller 4D with the transfer belt 4A in between. As illustrated in FIG. 5B, in the monochrome printing mode, the contacting portions 301Y, 301M and 301C contact upper end surfaces of the convex portions 82Y, 82M and 82C, respectively. Specifically, in the monochrome printing mode, the image forming units 30Y, 30M and 30C shift upward, thereby separating from the transfer belt 4A and the transfer roller 4D. When shifting from the color printing mode to the monochrome printing mode, the contacting portion 301Y contacts the concave portion 83Y by way of the slope 84Y from a state where the contacting portion 301Y contacts the convex portion 82Y. The contacting portion 301M contacts the concave portion 83M by way of the slope 84M from a state where the contact portion 301M contacts the convex portion 82M. The contacting portion 301C contacts the concave portion 83C by way of the slope 84C from a state where the contact portion 301C contacts the convex portion 82C. On the other hand, when shifting from the monochrome printing mode to the color printing mode, the contacting portions 301Y, 301M and 301C follow the reverse of the above described route.

Figure 6:
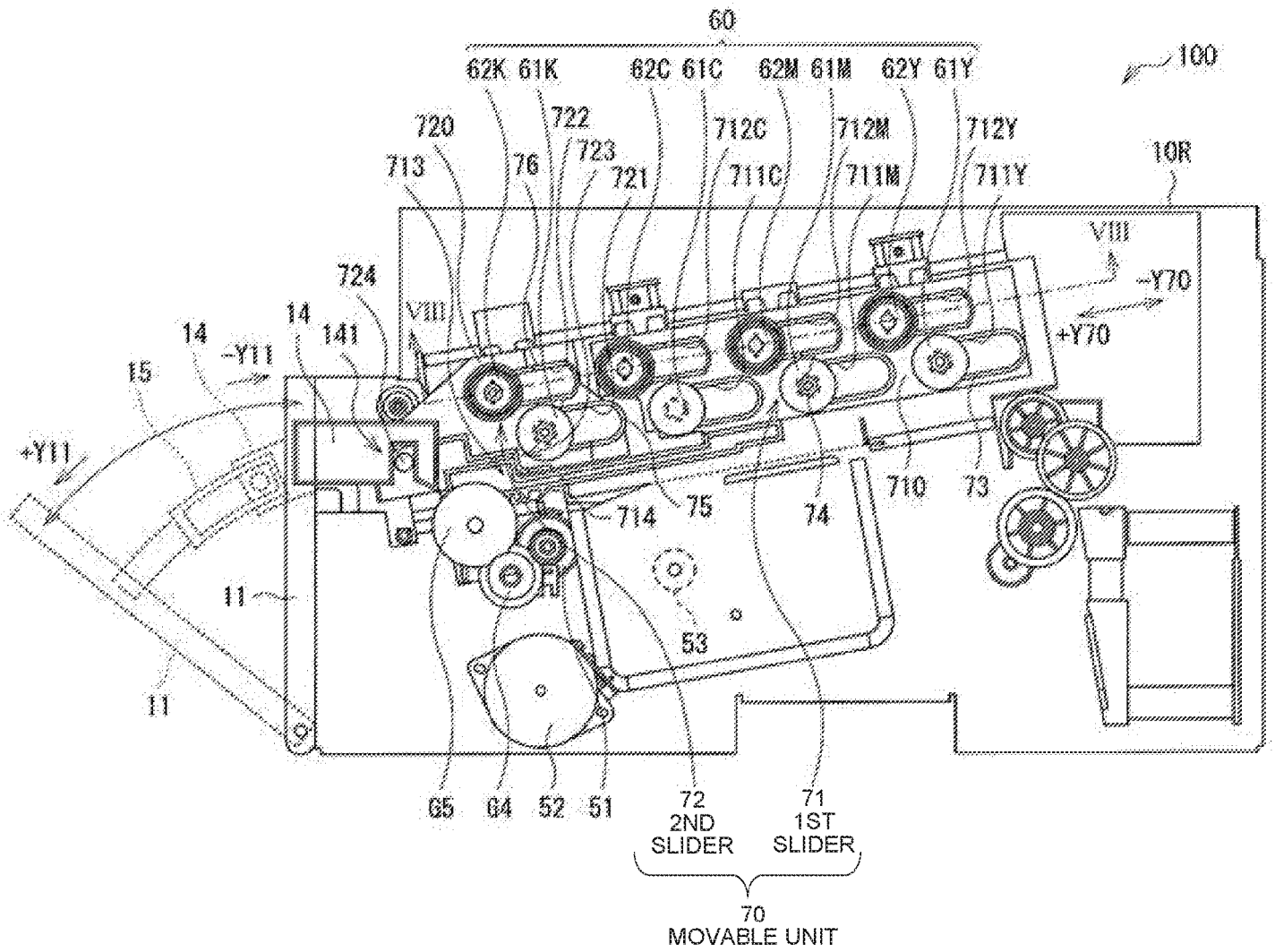
FIG. 6 is a front view illustrating an example of a general configuration of a movable unit in the image forming apparatus illustrated in FIG. 1.

Next, the detailed configurations of the driving force transmission unit 60 and the movable unit 70 will be described. FIG. 6 is a front view illustrating an example of a general configuration of the driving force transmission unit 60 and the movable unit 70 in the image forming apparatus 100 illustrated in FIG. 1. In FIG. 6, the cover 13 illustrated in FIG. 2B is omitted in order to enhance the visibility of the driving force transmission unit 60 and the movable unit 70.

As illustrated in FIG. 6, the front cover 11 as one specific example corresponding to "opening and closing member" in the technology is provided in a part of the casing 10. The front cover 11 can selectively perform an opening operation as "first operation" to communicate the inside of the casing 10 with the outside of the casing 10 and a closing operation as "second operation" to block the inside of the casing 10 and the outside of the casing 10 by a user. The opening operation is an operation in which the front cover 11 moves from a closed position illustrated by a solid line to an open position illustrated by a broken line. The closed position is a position to block the inside of the casing 10 and the outside of the casing 10. The open position is a position to communicate the inside of the casing 10 and the outside of the casing 10. On the other hand, the closing operation is an operation in which the front cover 11 moves from the opened position illustrated by the broken line to the closed position illustrated by the solid line. Further, a connecting member 14 and a drawer member 15 are provided in the casing 10. The connecting member 14 connects to a part of a second slider 72 in the movable unit 70. The drawer member 15 connects the connecting member 14 and the front cover 11. The connecting member 14 includes a concave portion 141 engaging with a protrusion portion 724 provided at the second slider 72. The combination of the front cover 11, the connecting member 14, the drawer member 15 and the second slider 72 corresponds to one specific example of "operation portion" in the technology. The concave portion 141 corresponds to one specific example of "operation engaging portion" in the technology. The protrusion portion 724 corresponds to one specific example of "slider engaging portion" in the technology.

Further, the first clutch 51, the sheet feeding motor 52, the ID motor 53, a gear G4 and a gear G5 are provided in the side plate 10R of the casing 10. Driving force generated by the sheet feeding motor 52 is supplied to the first slider 71 of the movable unit 70 by way of the first clutch 51, the gear G4 and the gear G5 in order.

As illustrated in FIG. 6, the driving force transmission unit 60 includes the drum drive couplers 61Y, 61M, 61C and 61K and the developing drive couplers 62Y, 62M, 62C and 62K. The drum drive couplers 61Y, 61M, 61C and 61K corresponds to the each of photosensitive drums 33 of the image forming units 30Y, 30M, 30C and 30K. The developing drive couplers 62Y, 62M, 62C and 62K corresponds to each of the developing rollers 35 of the image forming units 30Y, 30M, 30C and 30K. In the following description, the drum drive couplers 61Y, 61M, 61C and 61K may be collectively referred to as "drum drive coupler 61". The developing drive coupler 62Y, 62M, 62C and 62K may be collectively referred to as "developing drive coupler 62". The drum drive coupler 61 and the developing drive coupler 62 correspond to one specific example of "coupler" in the technology.

As illustrated in FIG. 6, the movable unit 70 includes the first slider and the second slider 72.

The first slider 71 includes a plate-shaped member 710 that has openings 711Y, 711M and 711C through which respective drum drive couplers 61Y, 61M and 61C are inserted, and openings 712Y, 712M and 712C through which respective developing drive couplers 62Y, 62M and 62C are inserted. The first slider 71 further includes a contacting portion 713 and a gear portion 714. The contacting portion 713 corresponds to one specific example of "first contacting portion" in the technology. The gear portion 714 is provided so as to mesh with teeth of the gear G5. In accordance with the rotation operation of the gear G5, the first slider 71 moves in a +Y70 direction or a −Y70 direction indicated by the arrow, along the longitudinal direction Y70. The position of the first slider 71 in illustrated in FIG. 6 is a position where the first slider 71 has moved the most in the −70 direction, that is, the position corresponding to the color printing mode (color printing position).

The second slider 72 includes a plate-shaped member 720 that has an opening 721 through which the drum drive couplers 61K corresponding to the image forming unit 30K is inserted, and an opening 722 through which the developing drive couplers 62K corresponding to the image forming unit 30K is inserted. The second slider 72 further includes a contacting portion 723 provided so as to be able to contact the contacting portion 713 of the first slider 71, and the protrusion portion 724 engaging with the concave portion 141 of the connecting member 14. The contacting portion 723 corresponds to one specific example of "second contacting portion" in the technology, and the protrusion portion 724 corresponds to one specific example of "slider engaging portion" in the technology.

Figure 7:
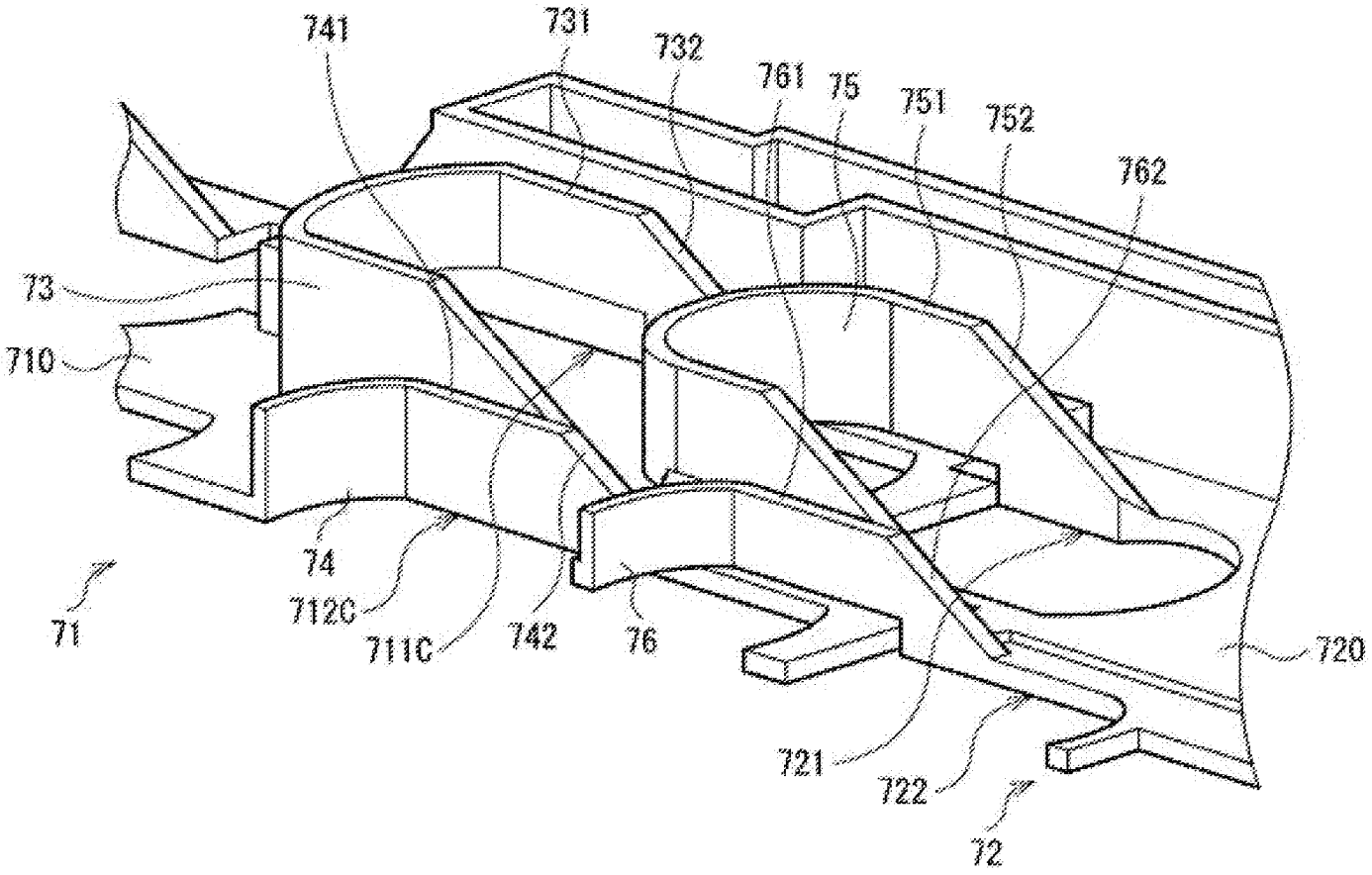
FIG. 7 is an enlarged perspective view illustrating the main part of the movable unit illustrated in FIG. 6.

FIG. 7 is an enlarged perspective view illustrating the main part of the first slider 71 and the second slider 72. As illustrated in FIG. 6 and FIG. 7, a plurality of guide walls 73 and a plurality of guide walls 74 are provided in the plate-shaped member 710 of the first slider 71. The guide walls 73 are provided along each periphery edge of the openings 711Y, 711M and 711C. The guide walls 74 are provided along each periphery edge of the openings 712Y, 712M and 712C. Each of the guide walls 73 include an upper end surface 731 projecting from the plate-shaped member 710 and an inclined surface 732 inclining with respect to the plate-shaped member 710. The inclined surface 732 extends from the plate-shaped member 710 to the upper end surface 731. Identically, each of the guide walls 74 include an upper end surface 741 projecting from the plate-shaped member 710 and an inclined surface 742 inclining with respect the plate-shaped member 710. The inclined surface 742 extends from the plate-shaped member 710 to the upper end surface 741. In FIG. 7, the opening 711C among the openings 711Y, 711M and 711C and a guide walls 73 provided along the periphery edge of the opening 711C, and the opening 712C among the openings 712Y, 712M and 712C and a guide wall 74 provided along the periphery edge of the opening 712C are illustrated.

A guide wall 75 and a guide wall 76 are provided in the plate-shaped member 720 of the second slider 72. The guide wall 75 is provided along the periphery edge of the opening 721. The guide wall 76 is provided along the periphery edge of the opening 722. The guide wall 75 includes an upper end surface 751 projecting from the plate-shaped member 720 and an inclined surface 752 inclining with respect to the plate-shaped member 720. The inclined surface 752 extends from the plate-shaped member 720 to the upper end surface 751. Identically, the guide wall 76 includes an upper end surface 761 projecting the plate-shaped member 720 and an inclined surface 762 inclining with respect to the plate-shaped member 720. The inclined surface 762 extends from the plate-shaped member 720 to the upper end surface 761.

Figure 8:
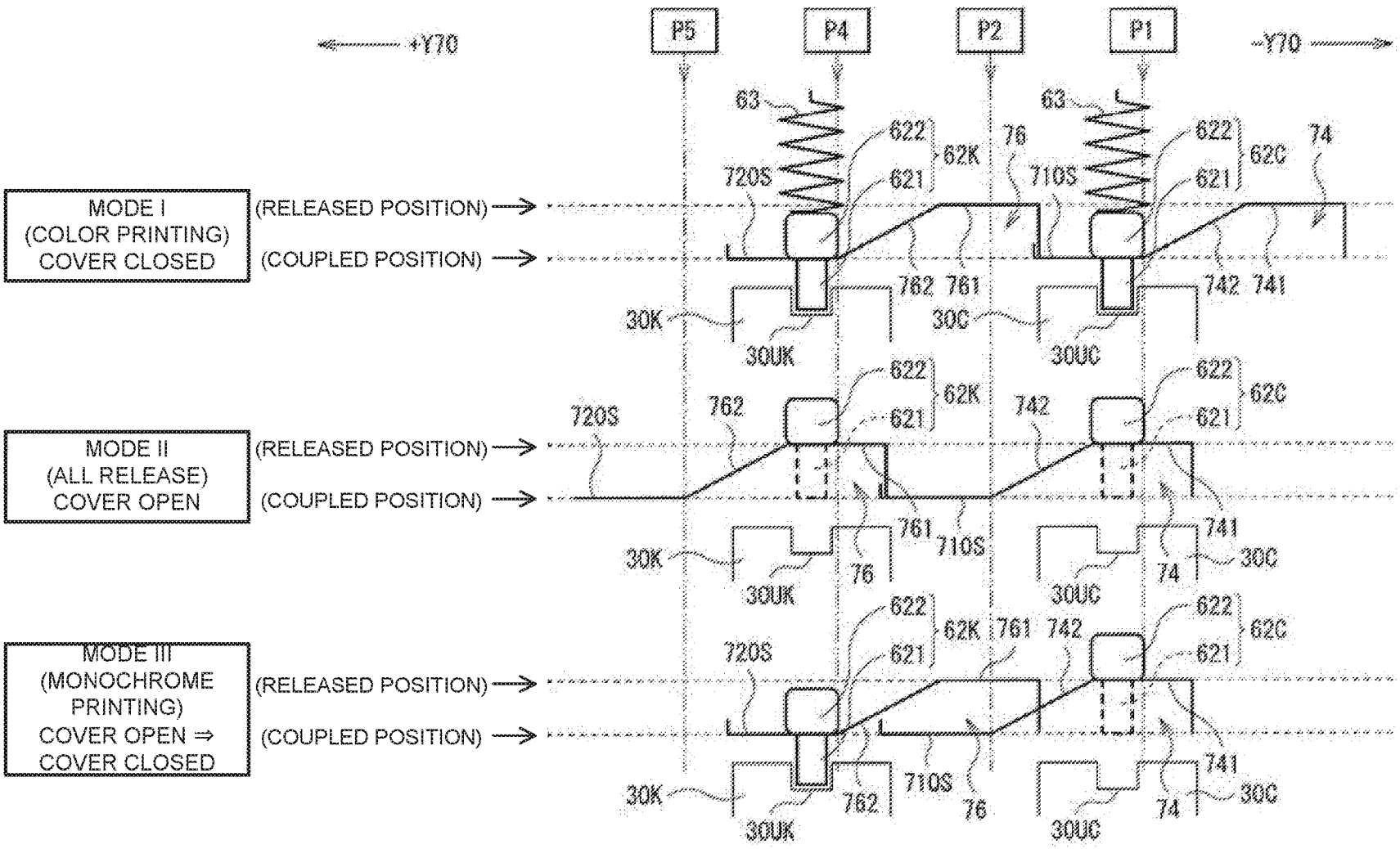
FIG. 8 is a schematic cross-sectional view illustrating the positional relationship between a driving force transmission unit and the movable unit illustrated in FIG. 6.

FIG. 8 is a schematic cross-sectional view in a direction of an arrow along line VII-VII (FIG. 6), including the developing drive couplers 62C and 62K, the first slider 71 and the second slider 72. As illustrated in FIG. 8, the developing drive coupler 62C includes a neck portion 621 inserted through the opening 712C of the first slider 71 and a head portion 622 in contact with the guide wall 74. The developing drive coupler 62Y and the developing drive coupler 62M each includes the same configuration as the developing drive coupler 62C. Specifically, the developing drive coupler 62Y includes a neck portion 621 inserted through the opening 712Y of the first slider 71 and a head portion 622 in contact with the guide wall 74. The developing drive coupler 62M includes a neck portion 621 inserted through the opening 712M of the first slider 71 and a head portion 622 in contact with the guide wall 74. Similarly, the developing drive coupler 62K includes a neck portion 621 inserted through the opening 722 of the second slider 72 and a head portion 622 in contact with the guide wall 76. The head portions 622 are urged by urging members 63 such as coil springs so as to always contact the guide walls 74. The head portion 622 is urged by an urging member 63 such as coil springs so as to always contact the guide wall 76. The neck portions 621 of the developing drive couplers 62 fit into the concave portions 30U provided at the image forming units 30. The term "coupled state" of the image forming units 30 and the driving unit 50 may refer to a state in which the neck portions 621 fit into the concave portions 30U, and the term "released state" of the image forming units 30 and the driving unit 50 may refer to a state in which the neck portions 621 separate from the concave portions 30U. The coupled state is a state in which driving force of the ID motor 53 is able to transmit to the image forming units 30. The released state is a state in which driving force from the ID motor 53 is not able to transmit to the image forming units 30. That is, the released state is a state in which the driving force is not transmitted. In FIG. 8, the image forming units 30C and 30K among four image forming units 30 and the concave portions 30UC and 30UK provided at the image forming units 30C and 30K are illustrated.

The drum drive couplers 61Y, 61M, 61C and 61K include substantially the same configuration as the developing drive couplers 62Y, 62M, 62C and 62K. That is, the drum drive couplers 61Y, 61M and 61C include neck portions inserted through the opening 711Y, 711M and 711C of the first 71 and head portions in contact with the guide walls 73, respectively. Identically, the drum drive coupler 61K includes a neck portion inserted through the opening 722 of the second slider 72 and a head portion in contact with the guide wall 76.

The driving force transmission unit 60 and the movable unit 70 are configured to be linked the opening and closing operation of the front cover 11. FIG. 8 is schematically illustrated three modes (mode I, mode II and mode III) in the image forming apparatus 100, related to opening and closing operation of the front cover 11.

The mode I is the color printing mode in which the color printing can be performed by using all of the image forming units 30Y, 30M, 30C and 30K, and corresponds to the coupled state between the image forming units 30 and the driving unit 50. In the mode I, both of the drum drive couplers 61 and the developing drive couplers 62 are at the coupled position. In the coupled position, the drum drive couplers 61 and the developing drive couplers 62 can transmit driving force of the ID motor 53 to the image forming units 30. The coupled position may refer to a position in which the drum drive couplers 61 and the developing drive couplers 62 are coupled to both of the image forming units 30 and the ID motor 53 of the driving unit 50. Specifically, in the mode I, in the first slider 71, the head portions 622 urged by the urging members 63 are in contact with the upper surface 710S of the plate-shaped member 710, and the neck portions 621 penetrate the openings 712 of the plate-shaped member 710 and projects to the opposite to the upper surface 710S of the plate-shaped member 710. The tips of the projecting neck portions 621 are engaged with the concave portions 30U. FIG. 8 is illustrated an appearance in which a tip of the neck portion 621 of the developing drive coupler 62C is engaged with the concave portion 30UC of the image forming unit 30C. Similarly, in mode I, in the second slider 72, the head portion 622 urged by the urging member 63 is in contact with the upper surface 720S of the plate-shaped member 720, and the neck portion 621 penetrates the openings 722 of the plate-shaped member 720 and projects to the opposite to the upper surface 720S of the plate-shaped member 720. The tip of the projecting neck portion 621 of the developing drive coupler 62K is engaged with the concave portion 30UK of the image forming unit 30K.

Figure 9B:
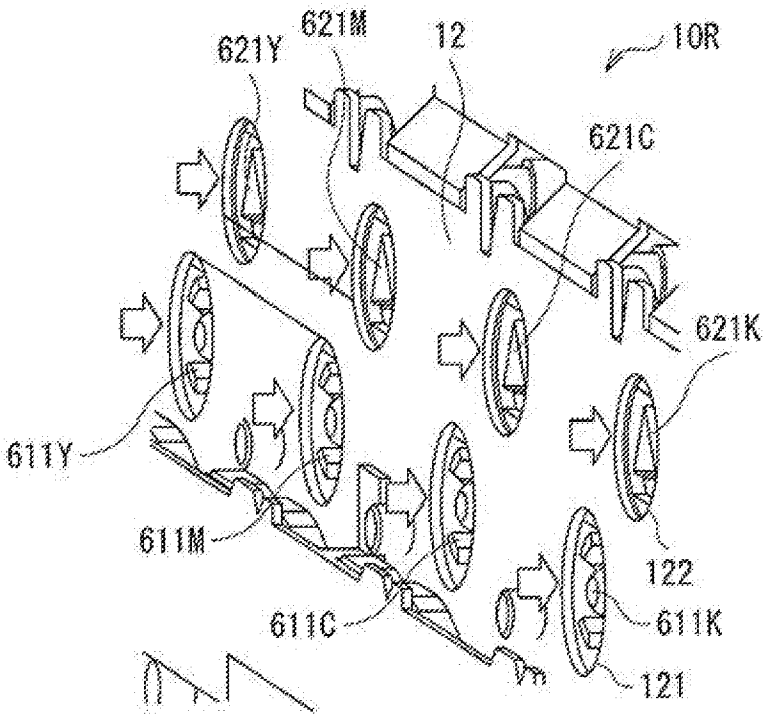
FIG. 9B is an enlarged perspective view illustrating the main part of the driving force transmission unit corresponding to a mode II illustrated in FIG. 8.
Figure 9A:
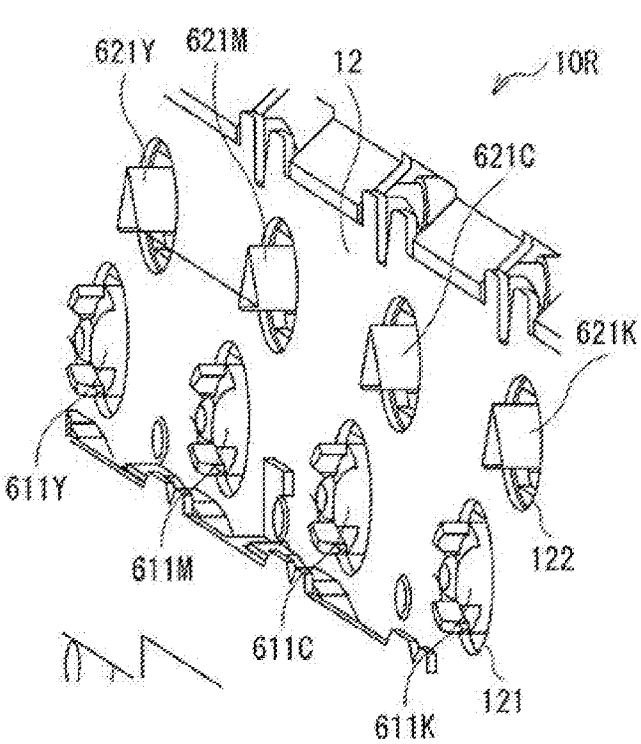
FIG. 9A is an enlarged perspective view illustrating the main part of the driving force transmission unit corresponding to a mode I illustrated in FIG. 8.

FIG. 9A is an enlarged perspective view illustrating the main part of the surface of the slide plate 10R facing the side plate 10L in the mode I. As illustrated in FIG. 9A, the neck portions 621Y, 621M, 621C and 621K of the developing drive couplers 62 project from openings 122 provided in the cover 12 toward the inside of the casing 10, that is, toward the image forming units 30. Similarly, the neck portion 611Y, 611M, 611C and 611K of the drum drive couplers 61 project from the openings 121 provided in the cover 12 toward the inside of the casing 10, that is, toward the image forming units 30.

The mode II is released state in which all of the image forming units 30Y, 30M, 30C and 30K are released from the driving unit 50. The mode II corresponds to a state in which printing cannot be performed. In the mode II, the drum drive couplers 61 and the developing drive couplers 62 are all at the released position. In the released position, the drum drive couplers 61 and the developing drive couplers 62 are separated from all of the image forming units 30Y, 30M, 30C and 30K, and therefore the driving force from the ID motor 53 is not transmitted to the image forming units 30. That is, the released position may refer to a position in which the drum drive couplers 61 and the developing drive couplers 62 separate from at least one of the image forming units 30 and the ID motor 53 of the driving unit 50. Specifically, in the mode II, in the first slider 71, the head portions 622 urged by the urging members 63 are in contact with the upper end surfaces 741 of the guide walls 74. In the mode II, the tips of the neck portions 621 retract to the height position substantially equal to the upper surface 710S of the plate-shaped member 710 or the front side from the upper surface 710S, and therefore the neck portions 621 are hidden by the guide walls 74. The tips of the retracted neck portions are separated from the concave portions 30U. FIG. 8 is illustrated a state in which the tip of the neck portion 621 of the developing drive coupler 62C is separated from the concave portion 30UC of the image forming unit 30C. Similarly, in the mode II, in the second slider 72, the head portion 622 urged by the urging member 63 is in contact with the upper end surface 761 of the guide wall 76. In the mode II, the tip of the neck portion 621 retracts to the height position substantially equal to the upper surface 720S of the plate-shaped member 720 or the front side from the upper surface 720S, and therefore the neck portion 621 is hidden by the guide wall 76. The tip of the retracted neck portion 621K is separated from the concave portions 30UK.

FIG. 9B is an enlarged perspective view illustrating the main part of the surface of the side plate 10R facing the side plate 10L, in the mode II. As illustrated in FIG. 9B, the neck portions 621Y, 621M, 621C and 621K of the developing drive couplers 62 are a state that retracts from the surface of the cover 12 toward the outside of the side plate 10R. Similarly, the neck portions 611Y, 611M, 611C and 611K of the drum drive couplers 61 are a state that also retracts from the surface of the cover 12 toward the outside of the side plate 10R.

Figure 10A:
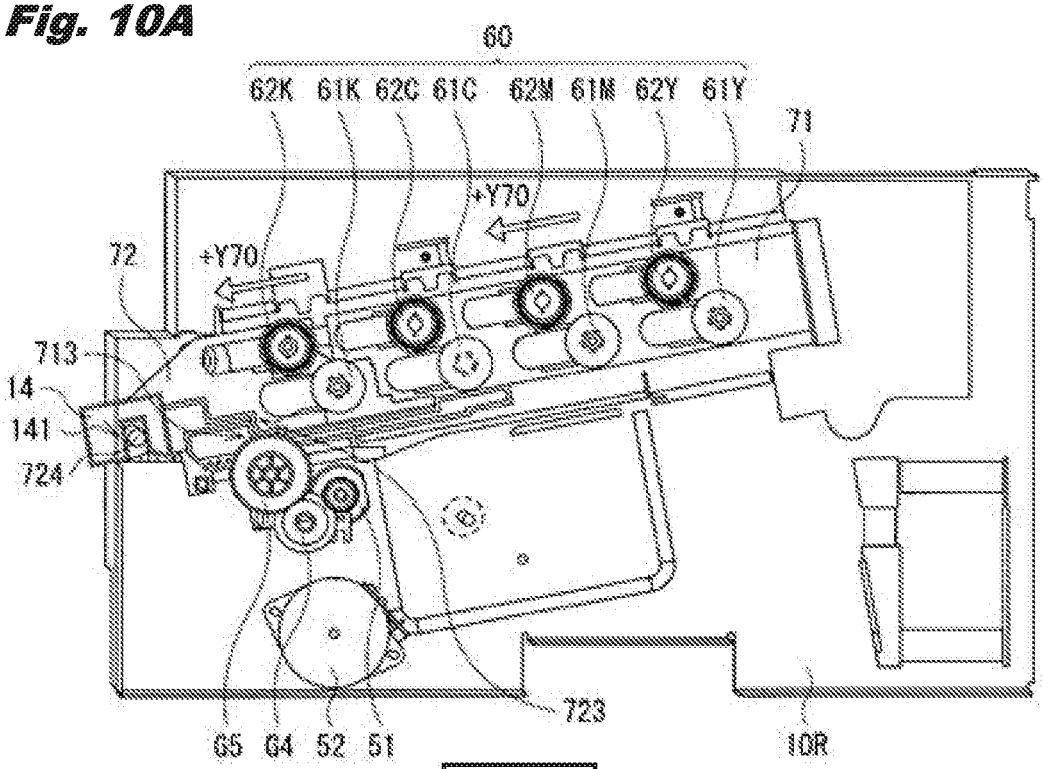
FIG. 10A is a front view illustrating an example of a general configuration of a side plate, the driving force transmission unit and the movable unit, in the mode II illustrated in FIG. 8.

FIG. 10A is a front view illustrating an example of a general configuration of the side plate 10R, the driving force transmission unit 60 and the movable unit 70, in the mode II. FIG. 10A corresponds to FIG. 6. As illustrated in FIG. 10A, the connecting member 14 and the second slider 72 are a state that has moved to forward (+Y70 direction) such that a part of the connecting member 14 protrudes from the side plate 10R. Further, the first slider 71 is a state that has moved to forward (+Y70 direction) as with the second slider 72.

The mode III is the monochrome printing mode that performs the monochrome printing using the image forming unit 30K without using the image forming units 30Y, 30M and 30C. In the mode III, the drum drive coupler 61K and the developing drive coupler 62K corresponding to the image forming unit 30K are both at the coupled position. On the other hand, the drum drive couplers 61Y, 61M and 61C and the developing drive couplers 62Y, 62M and 62C corresponding to the image forming units 30Y, 30M and 30C are in all at the released position. Specifically, in the mode III, the head portions 622 urged by the urging members 63 are in contact with the upper end surfaces 741 of the guide walls 74 in the first slider 71. In the mode III, the tips of the retracted neck portions 621 are separated from the concave portions 30U. FIG. 8 is illustrated a state in which the tip of the neck portion 621C of the developing drive coupler 62C is separated from the concave portion 30UC of the image forming unit 30C. Specifically, in the mode III, in the second slider 72, the head portions 622 urged by the urging member 63 is in contact with the upper surface 720S of the plate-shaped member 720, and the neck portion 621 penetrates the opening 722 of the plate-shaped member 720 and projects to the opposite to the upper surface 720S of the plate-shaped member 720. The tip of the neck portion 621 of the projected developing drive coupler 62K is engaged with the concave portion 30UK of the image forming unit 30K.

Figure 9C:
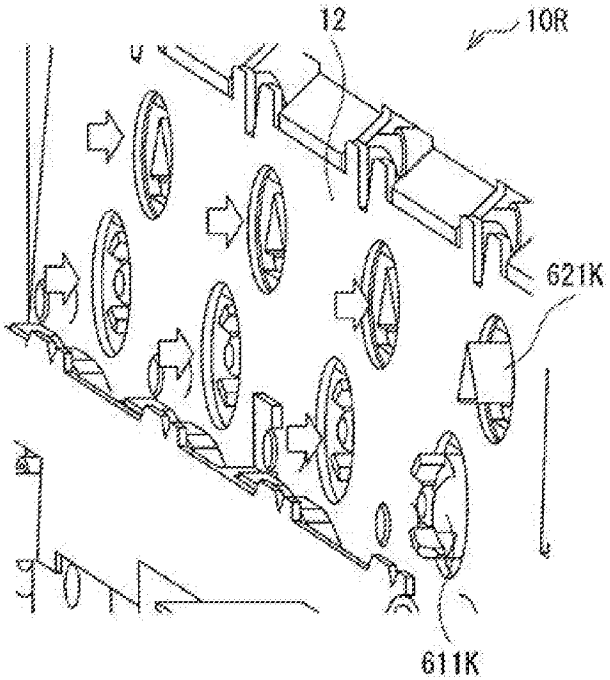
FIG. 9C is an enlarged perspective view illustrating the main part of the driving force transmission unit corresponding to a mode III illustrated in FIG. 8.

FIG. 9C is an enlarged perspective view illustrating the main part of the surface of the slide plate 10R facing the slide plate 10L, in the mode III. As illustrated in the FIG. 9C, the only neck portion 621K of the developing drive coupler 62K among four developing drive couplers protrudes from the opening 122 provided at the cover 12 toward the inside of the casing 10, that is, toward the image forming units 30. Similarly, the neck portion 611K of the drum drive coupler 61K among four drum drive couplers protrudes from the opening 121 provided at the cover 12 toward the inside of the casing 10, that is, toward the image forming units 30.

Figure 10B:
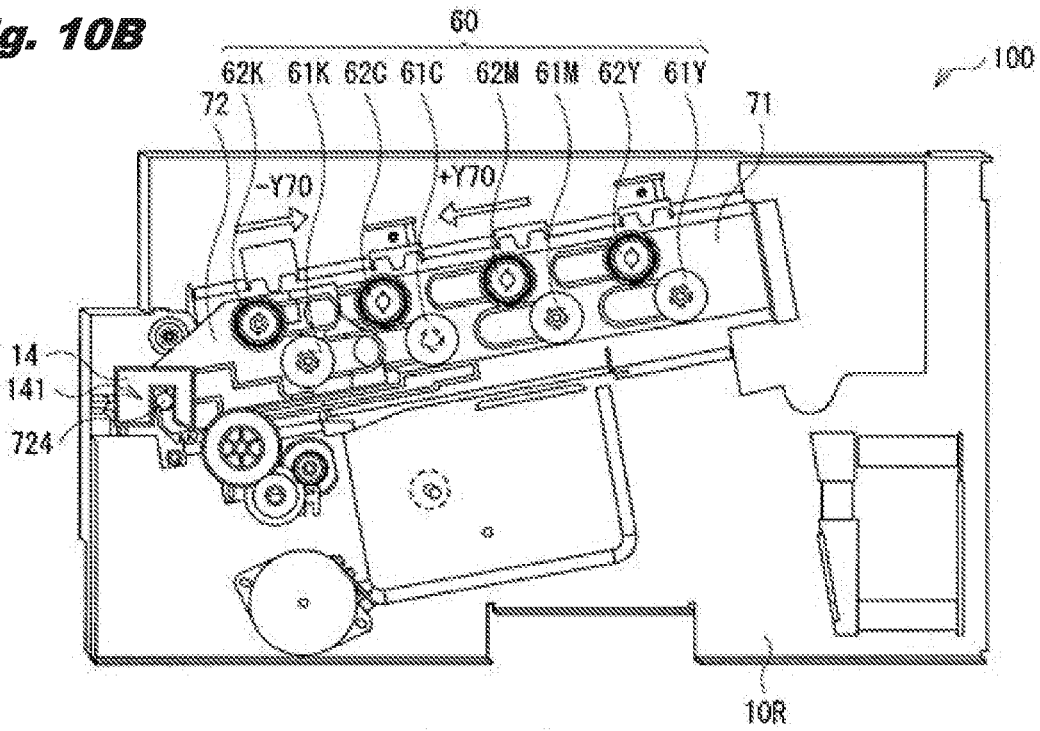
FIG. 10B is a front view illustrating an example of a general configuration of the side plate, the driving force transmission unit and the movable unit, in the mode III illustrated in FIG. 8.

FIG. 10B is a front view illustrating an example of a general configuration of the side plate 10R, the driving force transmission unit 60 and the movable unit 70, in the mode III. FIG. 10B corresponds to FIG. 6. As illustrated in FIG. 10B, the connecting member 14 and the second slider 72 are a state that has moved to backward (−Y70 direction) such that the connecting member 14 does not protrude from the side plate 10R. On the other hand, the first slider 71 is a state that has moved to forward (+Y70 direction), in contrast to the second slider 72.

The transition from the mode I to the mode II illustrated in FIG. 8 is performed, for example, in conjunction with opening operation of the front cover 11. As illustrated in FIG. 6, when the front cover 11 moves from the closed position illustrated by a solid line to the open position illustrated by a broken line in the direction of the arrow +Y11, the drawer member 15 and the connecting member 14 move in a direction of the arrow +Y11. The protrusion portion 724 of the second slider 72 is engaged with the concave portion 141, and therefore the second slider 72 is also pulled out forward in conjunction with the connecting member 14. As a result, the second slider 72 moves from the position P4 to the position P5 by the opening operation of the front cover 11. At that time, the contacting portion 713 of the first slider 71 is in contact with the contacting portion 723 of the second slider 72, and therefore the first slider 71 moves from the position P1 to the position P2 in conjunction with the second slider 72. The first slider 71 moves from the position P1 to the position P2, and therefore the head portions 622 of the developing drive couplers 62Y, 62M and 62C reach the upper end surface 741 via the inclined surface 742, and the head portions 611 of the drum drive couplers 61Y, 61M 61C reach the upper end surface 731 via the inclined surface 732. On the other hand, the second slider 72 moves from the position P4 to the position P5, and therefore the head portion 622 of the developing drive coupler 62K reaches the upper end surface 761 via the inclined surface 762, and the head portion 611 of the drum drive couplers 61K reaches the upper end surface 751 via the inclined surface 752. As a result, the drum drive coupler 61 and the developing drive coupler 62 are all at the released position, and the transition from the mode I to the mode II is completed. In FIG. 8, the position P1 and the position P2 are illustrated a boundary position between the upper surface 710S of the plate-shaped member 710 and the inclined surface 742 of the guide wall 74. The position P4 and the position P5 are illustrated a boundary position between the upper surface 720S of the plate-shaped member 730 and the inclined surface 762 of the guide wall 76.

The transition from the mode II to the mode III illustrated in FIG. 8 is performed, for example, in conjunction with the closing operation of the front cover 11. As illustrated in FIG. 6, when the front cover 11 moves in a direction of the arrow −Y11 from the open position illustrated by a broken line to the closed position illustrated by a solid line, the drawer member 15 and the connecting member 14 move in a direction of the arrow −Y11. The protrusion portion 724 of the second slider 72 is engaged with the concave portion 141, and therefore the second slider 72 is also moved to backward in conjunction with the connecting member 14. As a result, the second slider 72 moves from the position P5 to the position P4 by the closing operation of the front cover 11. At that time, the contacting portion 713 of the first slider 71 is separated from the contacting portion 723 of the second slider 72, and therefore the first slider 71 stays at the position P2 without interlocking the second slider 72. The first slider 71 stays at the position P2, and therefore the state in which the head portions 622 of the developing drive couplers 62Y, 62M and 62C are in contact with the upper end surface 741 is maintained, and the state in which the head portions 611 of the drum drive couplers 61Y, 61M and 61C are in contact with the upper end surface 731 is maintained. On the other hand, the second slider 72 moves from the position P4 to the position P5, and therefore the head portion 622 of the developing drive coupler 62K reaches the upper end surface 761 via the inclined surface 762, and the head portion 611 of the drum drive coupler 61K reaches the upper end surface 751 via the inclined surface 752. As a result, the released position in the drum drive couplers 61Y, 61M and 61C and the developing drive couplers 62Y, 62M and 62C is maintained, while both the drum drive coupler 61K and the developing drive coupler 62K are at the coupled position. Thus the transition from the mode II to the mode III is completed. As illustrated in FIG. 7, FIG. 8 and FIG. 10B, in the mode III, the first slider 71 and the second slider 72 approach closest to each other, and therefore a part of the first slider 71 at the position P2 and a part of the second slider 72 at the position P4 overlap each other.

Further, the transition from the mode III to the mode I illustrated in FIG. 8 can be performed, for example, by transmitting the driving force of the sheet feeding motor 52 to the first slider 71 via the first clutch 51, the gear G4 and the gear G5 and being moved the first slider 71 in the −Y70 direction.

In the image forming apparatus 100, in the state where the front cover 11 is positioned at the closed position (FIG. 6), the toner image is formed on the medium PM in the following manner.

When the printing data and the control command are input from the external device such as the external computer via the interface unit 21 and the command-image processing unit 22 to the controller 20 of the image forming apparatus 100 in an activated state, the controller 20 causes the printing operation of the printing data to start in response to the control command. At that time, the controller 20 selects the mode I when performing color printing, and selects the mode III when performing monochrome printing.

The controller 20 drives the ID motor 53 in the driving unit 50, and causes the photosensitive drum 33 and the developing roller 35 via the driving force transmission unit 60 to rotate in the direction of arrow Y33 and Y35 (see, FIG. 3) at a constant speed. When the photosensitive drum 33 and the developing roller 35 are rotated, driving force is transmitted to the charging roller 34 and the feeding roller 36 via a gear train. As a result, as illustrated in FIG. 3, the charging roller 34 rotates the direction of arrow Y34, and the feeding roller 36 rotates the direction of arrow Y36.

The controller 20 applies a predetermined charging voltage for the charging roller 34 to be charged the surface of the photosensitive drum 33.

Next, the controller 20 activates the exposure device 39 to irradiate light corresponding to the color component of the printing image based on the image signal to the photosensitive drum 33 and form the electrostatic latent image on the surface of the photosensitive drum 33. Further, in the image forming units 30, the toner TN is developed with respect to the electrostatic latent image formed on the surface of the photosensitive drum 33 in the following manner.

Specifically, first, the toner TN is introduced from the toner cartridge 31 to the image forming cartridge 32. The toner TN is supported on the feeding roller 36 and moves to the vicinity of the developing roller 35 by a rotation of the feeding roller 36. At that time, the toner TN is negatively charged, for example, due to friction between the developing roller 35 and the feeding roller 36 and a potential difference between the electric potential of the developing roller 35 and the electric potential of the feeding roller 36, and supplied to the developing roller 35. The toner TN supplied to the developing roller 35 forms a toner layer regulated a predetermined thickness by the toner regulatory blade 37. After that, the toner layer on the developing roller 35 is developed to the electrostatic latent image formed on the surface of the photosensitive drum 33, thereby being formed the toner image on the surface of the photosensitive drum 33.

On the other hand, the controller 20 is activated the belt driving motor 55 and causes the conveyance of the medium PM to start. By the conveyance control, the medium PM is conveyed, at a predetermined conveying speed, to the transferring section 4 in which the photosensitive drum 33 faces the transfer roller 4D. Specifically, as illustrated in FIG. 1, the medium PM stored in the container tray 1A is taken out one by one from the topmost of stacked media PM by the sheet feeding roller 1B and fed in a direction of the conveyance roller 1C. The medium PM fed from the sheet feeding roller 1B is conveyed to the transferring section 4 while a skew of the medium PM is controlled by the conveyance roller 1C and the conveyance section 2.

In conjunction with the timing of conveyance of the medium PM to the transferring section 4, a predetermined transfer voltage is applied to the transfer roller 4A provided opposite the photosensitive drum 33, on the basis of the control performed by the controller 20. The toner image formed on the photosensitive drum 33 is transferred on the surface of the medium PM traveling on the conveyance path PL between the photosensitive drum 33 and the transfer roller 4D.

The fixing section 5 applies heat and pressure to the toner image transferred onto the medium PM, thereby being fixed the toner image onto the medium PM. After that, the medium PM fixed the toner image is ejected to the external stacker 10A of the casing 10 from the ejecting section 6. The toner TN that has not been transferred to the medium PM may be slightly remained on the photosensitive drum 33, but the remaining toner TN is removed by the cleaning blade 38. Thus, the photosensitive drum 33 can be continuously used.

Figure 11A:
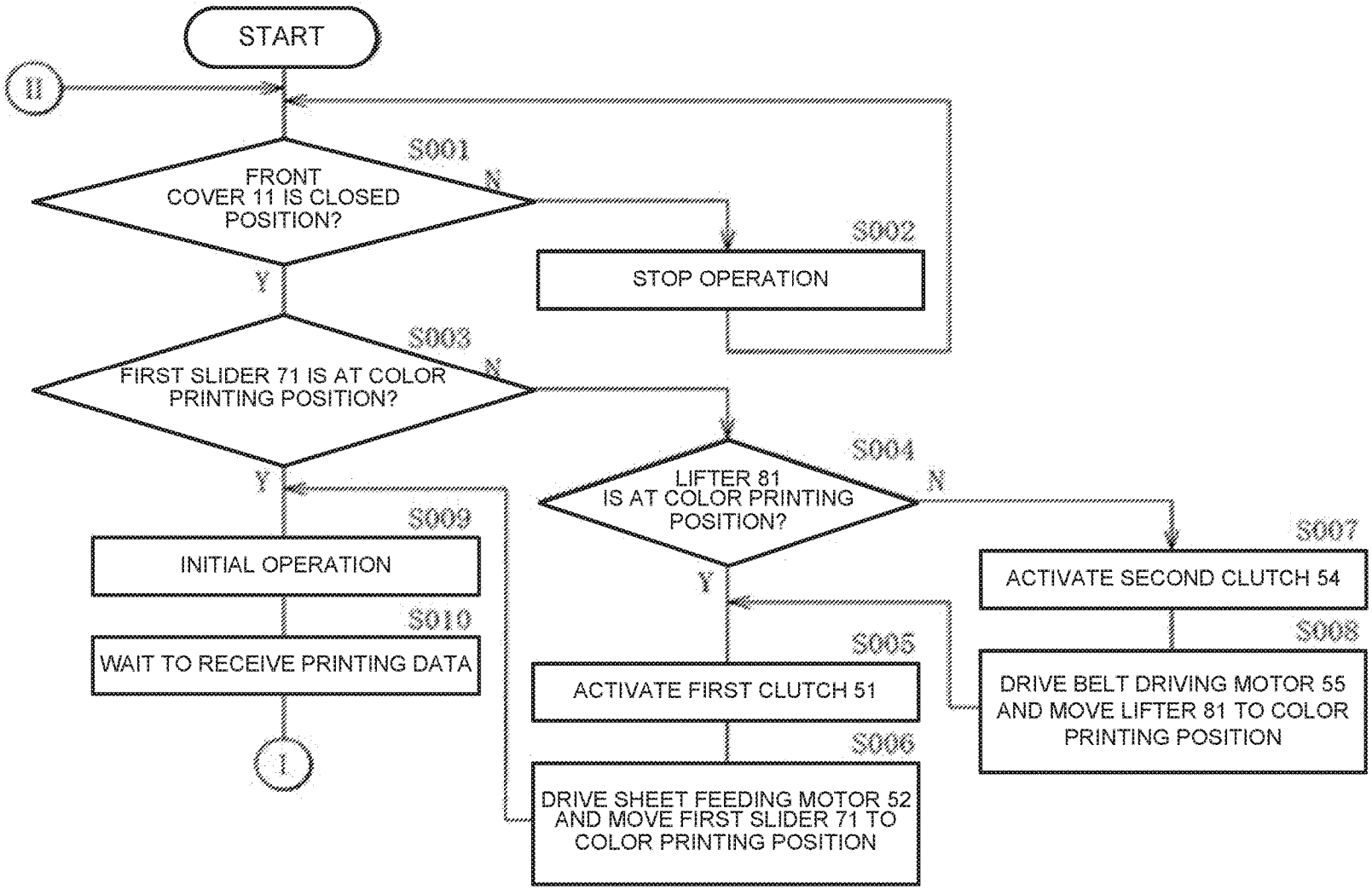
FIG. 11A is a flowchart illustrating an operation example of the image forming apparatus illustrated in FIG. 1.
Figure 11B:
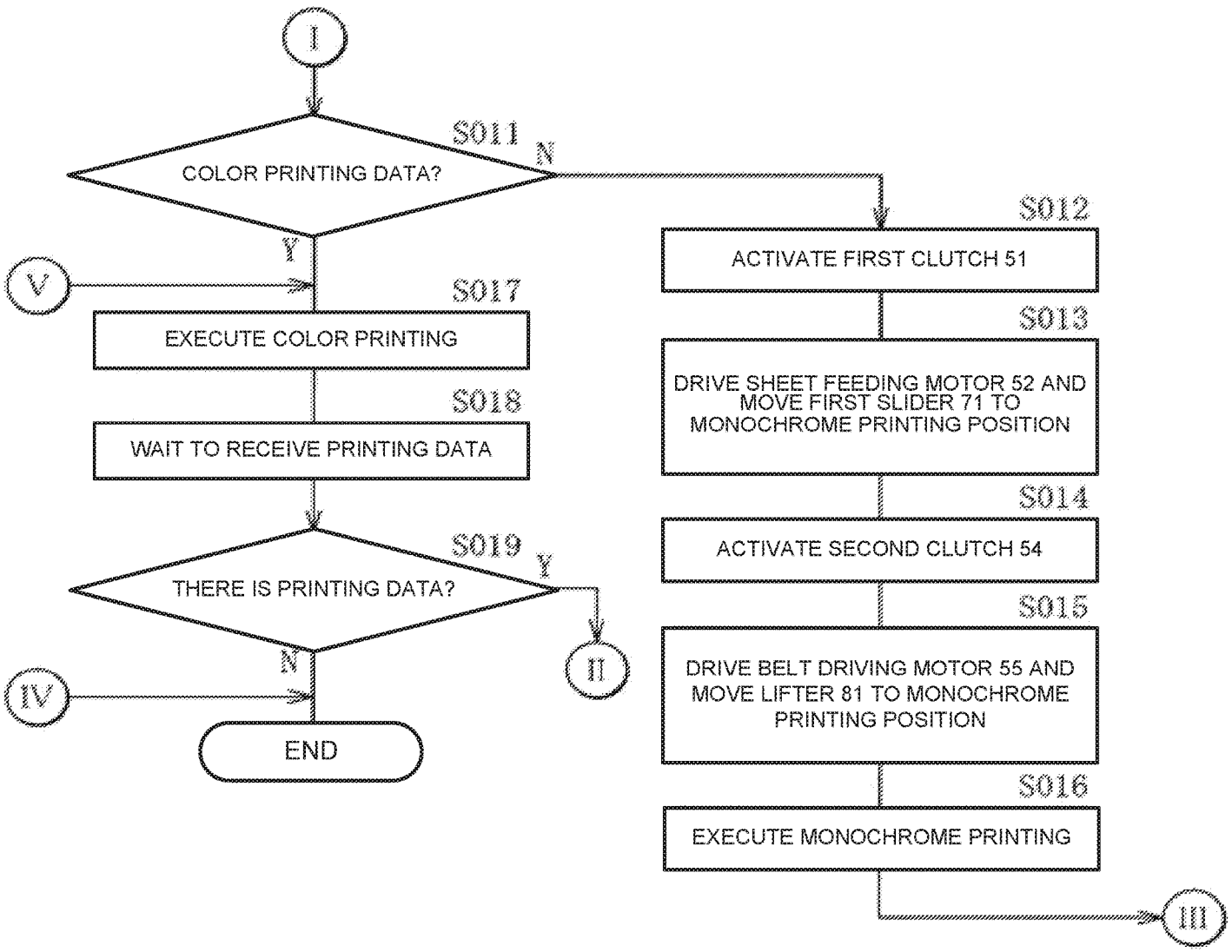
FIG. 11B is a flowchart illustrating an operation example of the image forming apparatus following the process illustrated in FIG. 11A.
Figure 11C:
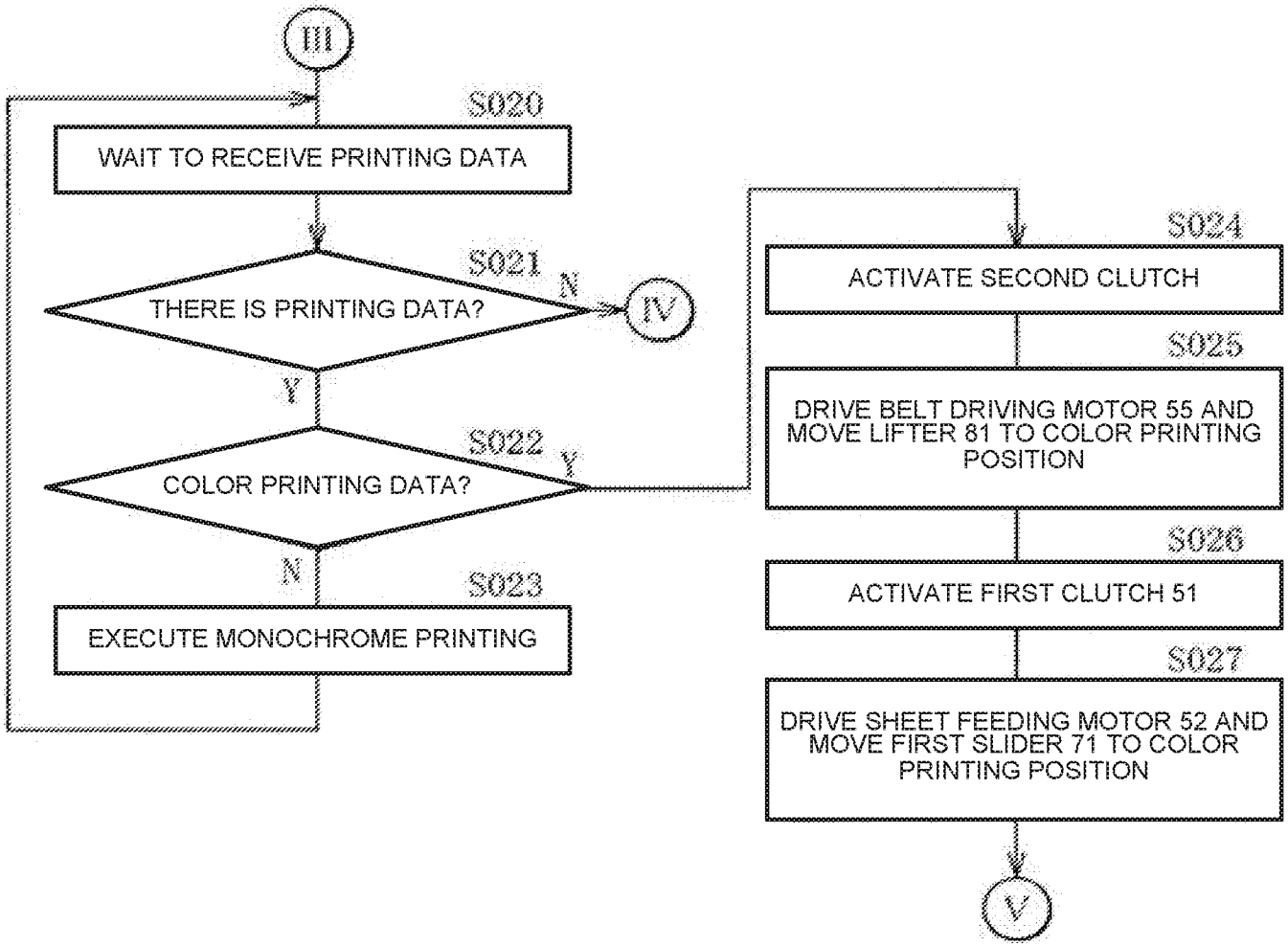
FIG. 11C is a flowchart illustrating an operation example of the image forming apparatus following the process illustrated in FIG. 11B.

Next, the details of the printing operation of the image forming apparatus 100 will be described with reference to FIG. 11A to FIG. 11C. The following printing operation is executed based on the control performed by the controller 20. FIG. 11A to FIG. 11C are flowcharts illustrated one operation example of the image forming apparatus 100 illustrated in FIG. 1.

First, as illustrated in FIG. 11A, in a state in which the image forming apparatus 100 is powered on, the controller 20 acquires position detection information of the front cover 11 from the front cover position detecting unit 26. That is, the controller 20 determines whether or not the front cover 11 is in the closed position (step S001). If the controller 20 is determined that the front cover 11 is not in the closed position (step S001N), the printing operation is stopped (step S002).

If the controller 20 determines that the front cover 11 is in the closed position (step S001Y), the controller 20 acquires position detection information of the first slider 71 from the first slider position detecting unit 24. Specifically, the controller 20 determines whether or not the first slider 71 is at a position (color printing position) corresponding to the color printing mode illustrated in FIG. 6 (step S003). That is, the controller 20 determines whether or not the drum drive couplers 61Y, 61M and 61C and the developing drive couplers 62Y, 62M and 62C are in the coupled position. If the controller 20 determines that the first slider 71 is at the position corresponding to the color printing mode illustrated in FIG. 6 (step S003Y), this flow proceeds to step S009. In step S009, an initial operation such as color correction based on information from the color deviation sensor 23A or density correction based on information from the density sensor 23B is performed. After that, it shifts to the print standby mode and waits for reception of printing data (step S010).

In step S003, if the controller 20 determines that the first slider 71 is not at the position corresponding to the color printing mode illustrated in FIG. 6 (step S003N), this flow proceeds to step S004. In step S004, the controller 20 acquires position detection information of the lifter 81 from the lifter position detecting unit 25. Specifically, the controller 20 determines whether or not the lifter 81 is at a position corresponding to the color printing mode (step S004). That is, the controller 20 determines whether or not each photosensitive drum 33 of the image forming units 30Y, 30M, 30C is in contact with the transfer belt 4A by shifting the image forming units 30Y, 30M and 30C downward. If the controller 20 determines that the lifter 81 is at the position corresponding to the color printing mode illustrated in FIG. 6 (step S004Y), the flow proceeds to step S005. In step S005, the first clutch 51 is activated, and driving force of the sheet feeding motor 52 is brought into a state capable of being transmitted to the first slider 71. After that, the sheet feeding motor 52 is driven, and the first slider 71 is moved in the −Y70 direction until the first slider 71 reaches the color printing position (step S006). At that time, the first slider position detecting unit 24 confirms that the first slider 71 has moved to the color printing position. The first slider 71 moves to the color printing position, and therefore the drum drive couplers 61Y, 61M and 61C and the developing drive couplers 62Y, 62M and 62C change over from the released position to the coupled position. After that, the flow proceeds to step S009.

In step S004, if the controller 20 determines that the lifter 81 is not at the position corresponding to the color printing mode illustrated in FIG. 6 (step S004N), the flow proceeds to step S007. In step S007, the second clutch 54 is activated, and driving force of the belt driving motor 55 is brought into a state capable of being transmitted to the lifter 81. After that, the belt driving motor 55 is driven, and the lifter 81 is moved straight in the −Y81 direction until the lifter 81 reaches the position corresponding to the color printing mode (step S008). At that time, the lifter position detecting unit 25 confirms that the lifter 81 moves to the position corresponding to the color printing mode. The lifter 81 moves to the position corresponding to the color printing mode, and therefore each the photosensitive drum 33 of the image forming units 30Y, 30M and 30C is shifted to a state in which each of the photosensitive drum 33 is in contact with the transfer belt 4A. After that, the flow proceeds to step S005.

As illustrated in FIG. 11B, after step S010, the controller 20 receives the printing data from the command-image processing unit 22 and determines whether or not the printing data is the color printing data (step S011). If the controller 20 determines that the color printing data is received (step S011Y), color printing on the medium PM is executed (step S017). After that, the controller 20 shifts to the print standby mode and waits for reception of the printing data (step S018). In step S019, the controller 20 determines the presence or absence of the printing data from the command-image processing unit 22. If the controller 20 determines that there is not printing data (step S019N), printing operation is ended (END). In step S019, if the controller 20 determines that there is printing data from the command-image processing unit 22 (step S019Y), the flow returns to step S001 (FIG. 11A).

In step S011, if the controller 20 determines that the received printing data is not the color printing data (step S011N), the flow proceeds to step S012. In step S012, the first clutch 51 is activated, and driving force of the sheet feeding motor 52 is brought into a state capable of being transmitted to the first slider 71. After that, the sheet feeding motor 52 is driven, the first slider 71 is moved in the +Y70 direction until the first slider 71 reaches a position (monochrome printing position) corresponding to the monochrome mode illustrated in FIG. 10B (step S013). The first slider 71 moves to the monochrome printing position, and therefore the drum drive couplers 61Y, 61M and 61C and the developing drive couplers 62Y, 62M and 62C change over from the coupled position to the released position. After that, the flow proceeds to step S014.

In step S014, the second clutch 54 is activated, and driving force of the belt driving motor 55 is brought into a state capable of being transmitted to the lifter 81. After that, the belt driving motor 55 is driven, and the lifter 81 is moved straight in the +Y81 direction until the lifter 71 reaches a position corresponding to the monochrome printing mode (step S015). The lifter 81 moves to the position corresponding to the monochrome printing mode, and therefore each the photosensitive drum 33 of the image forming units 30Y, 30M and 30C shifts to a state in which each of the photosensitive drums 33 is separated from the transfer belt 4A. After that, monochrome printing on the medium PM is executed (step S016), and the flow proceeds to step S020 (FIG. 11C).

In step S020 illustrated in FIG. 11C, the controller 20 shifts to the print standby mode and waits for reception of printing data. In step S021, the controller 20 determines the presence or absence of the printing data from the command-image processing unit 22. In step S021, if controller 20 determines that there is not printing data from the command-image processing unit 22 (step S021N), printing operation is ended (END). On the other hand, in step S021, if the controller 20 determines that there is printing data from the command-image processing unit 22 (step S021Y), the controller 20 receives printing data from the command-image processing unit 22 and determines whether or not the printing data is the color printing data (step S022). If the controller 20 determines that the received printing data is not the color printing data (step S022N), monochrome printing on the medium PM is executed (step S023), and the flow returns to step S020.

In step S022, if the controller 20 determines that the received printing data is the color printing data (step S022Y), the flow proceeds to step S024. In step S024, the second clutch 54 is activated, and driving force of the belt driving motor 55 is brought into a state capable of being transmitted to the lifter 81. After that, the belt driving motor 55 is driven, and the lifter 81 is moved straight in the −Y81 direction until the lifter 81 reaches the position corresponding to the color printing mode (step S025). At that time, the lifter position detecting unit 25 confirms that the lifter 81 moves to the position corresponding to the color printing mode. After that, the flow proceeds to step S026. In step S026, the first clutch 51 is activated, and driving force of the sheet feeding motor 52 is brought into a state capable of being transmitted to the first slider 71. After that, the sheet feeding motor 62 is driven, and the first slider 71 is moved in the −Y70 direction until the first slider 71 reaches the color printing position (step S027). At that time, the first slider position detecting unit 24 confirms that the first slider 71 moves to the color printing position. After that, the flow proceeds to step S017 (FIG. 11B).

Finally, in the step S019, if the controller 20 determines that there is not printing data (step S019N), printing operation is ended (END).

In the above described series of operation flows, for example, if the front cover 11 is temporarily opened and closed in the printing data reception standby state (step S018 and step S020), the image forming apparatus 100 executes the following printing operation. The details of printing operation of the image forming apparatus 100 after the opening and closing operation of the front cover 11 will be described with reference to FIG. 12A and FIG. 12B. The following printing operation is executed based on the control performed by the controller 20.

Figure 12A:
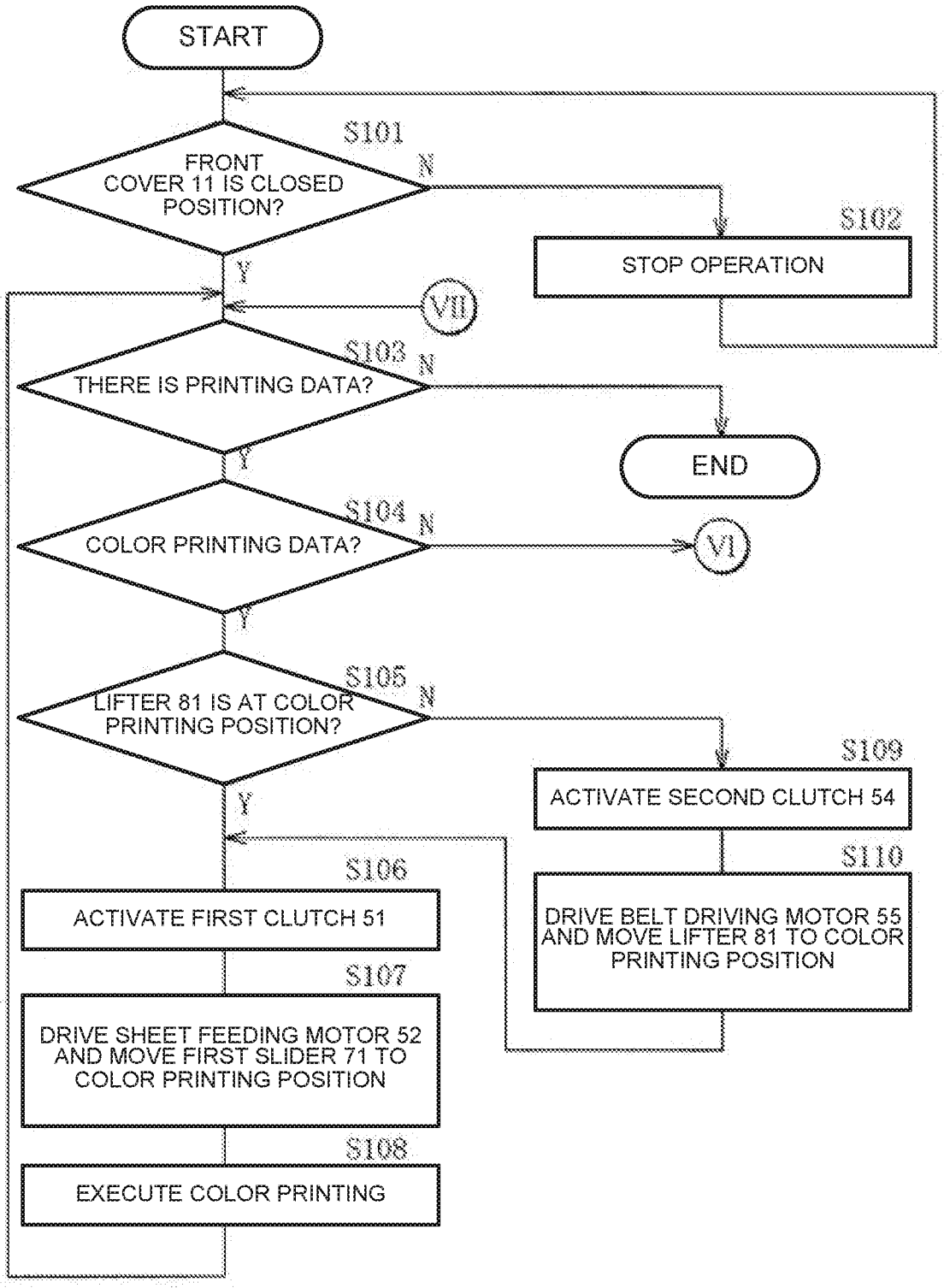
FIG. 12A is a flowchart illustrating another operation example of the image forming apparatus illustrated in FIG. 1.

As illustrated in FIG. 12A, in a state in which the image forming apparatus 100 is powered on, the controller 20 acquires position detection information of the front cover 11 from the front cover position detecting unit 26. That is, the controller 20 determines whether or not the front cover is at the closed position (step S101). If the controller 20 determines that the front cover 11 is not at the closed position (step S101N), printing operation is stopped (step S102).

If the controller 20 determines that the front cover 11 is at the closed position (step S101Y), the controller 20 determines the presence or absence of the printing data from the command-image processing unit 22 in step S103. If the controller 20 determines that there is not printing data (step S103N), printing operation is ended (END). If the controller 20 determines that there is the printing data in step S103 (step S103Y), the controller 20 receives the printing data from the command-image processing unit 22 and determines whether or not the printing data is the color printing data (step S104).

If the controller 20 determines that the color printing data is received (step S104Y), the flow proceeds to step S105. In step S105, the controller 20 acquires position detection information of the lifter 81 from the lifter position detecting unit 25. If the controller 20 determines that the lifter 81 is at a position corresponding to the color printing mode illustrated in FIG. 6 (step S105Y), the flow proceeds to step S106. In step S106, the first clutch 51 is activated, and driving force of the sheet feeding motor 52 is brought into a state capable of being transmitted to the first slider 71. After that, the sheet feeding motor 52 is driven, and the first slider 71 is moved in the −Y70 direction until the first slider 71 reaches the color printing position (step S107). At that time, the first slider position detecting unit 24 confirms that the first slider 71 moves to the color printing position. Following step S107, color printing on the medium PM is executed (step S108), and the flow returns to step S103. In step S105, if the controller 20 determines that the lifter 81 is not at the position corresponding to the color printing mode illustrated in FIG. 6 (step S105N), the flow proceeds to step S109. In step S109, the second clutch 54 is activated, and driving force of the belt driving motor 55 is brought into a state capable of being transmitted to the lifter 81. After that, the belt driving motor 55 is driven, and the lifter 81 is moved straight in the −Y81 direction until the lifter 81 reaches the position corresponding to the color printing mode (step S110). At that time, the lifter position detecting unit 25 confirms that the lifter 81 moves to the position corresponding to the color printing mode. After that, the flow proceeds to step S106.

Figure 12B:
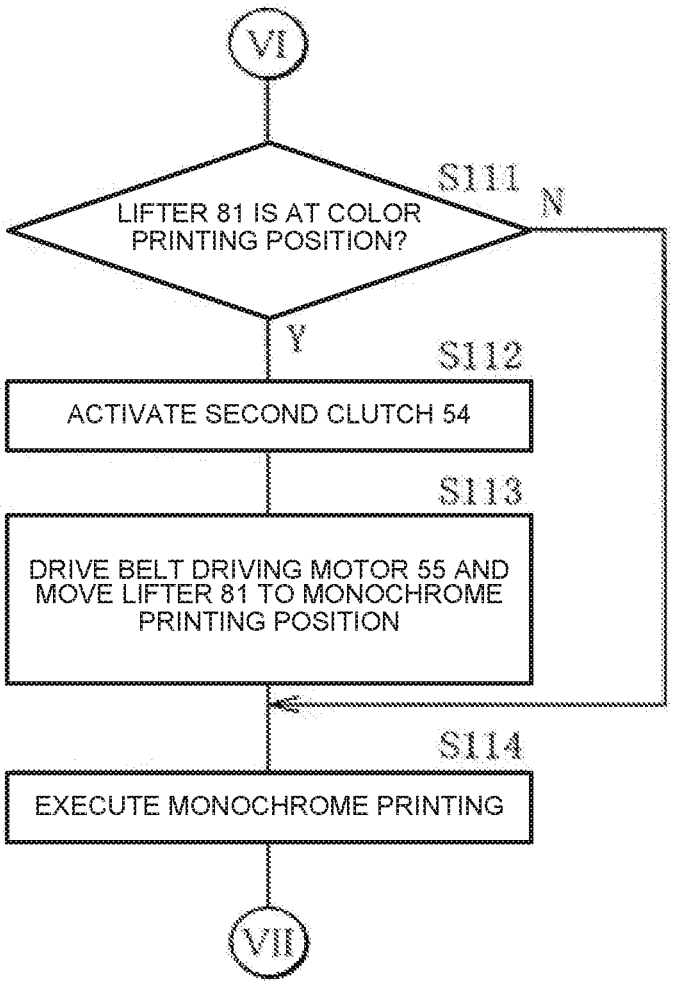
FIG. 12B is a flowchart illustrating another operation example of the image forming apparatus following the process illustrated in FIG. 12A.

In step S104, if the controller 20 determines that the received printing data is not the color printing data (step S104N), the flow proceeds to step S111 illustrated in FIG. 12B. In step S111, the controller 20 acquires position detection information of the lifter 81 from the lifter position detecting unit 25. If the controller 20 determines that the lifter 81 is at the position corresponding to the color printing mode illustrated in FIG. 6 (step S111Y), the flow proceeds to step S112. In step S112, the second clutch 54 is activated, and driving force of the belt driving motor 55 is brought into a state capable of being transmitted to the lifter 81. After that, the belt driving motor 55 is driven, and the lifter 81 is moved straight in the +Y81 direction until the lifter 81 reaches the position corresponding to the monochrome printing mode (step S113). After that, monochrome printing on the medium PM is executed (step S114), and the flow proceeds to step S103 (FIG. 12A). On the other hand, if the controller 20 determines that the lifter 81 is not at the position corresponding to the color printing mode illustrated in FIG. 6 in the step S111 (step S111N), the flow proceeds to step S114, and monochrome printing on the medium PM is executed (step S114).

Finally, in the step S103, if the controller 20 determines that there is not the printing data (step S103N), printing operation is ended (END).

As described above, in the image forming apparatus 100, color printing operation and the monochrome printing operation are performed by performing an appropriate processing in accordance with the open and close state of the front cover 11 or the coupled state the of driving force transmission unit 60 of the each image forming unit 30.

In the image forming apparatus 100 according to the present embodiment, the driving force transmission unit 60 and the movable unit 70 are provided, and a transition from the coupled state between the image forming units 30 and the driving unit 50 to the released state between the image forming units 30 and the driving unit 50 is performed. Further, a transition from the released state to the coupled state is performed. Therefore, it is possible to obtain a larger gear ratio, different for each color, by using a gear provided outside the image forming units 30. Accordingly, it is possible to expect more delicate gradation expression for each color and improve the reproducibility of the printing image with respect to the printing data. Further, in the image forming apparatus 100, when the opening operation of the front cover 11 is performed, the driving unit 50 and the image forming units 30 change over from the coupled state to the released state. On the other hand, even if the closing operation of the front cover 11 is performed, the released state is maintained. Therefore, even if the power force of the main body of the image forming apparatus 100 is turned off, once opening operation of the front cover 11 is performed regardless of the position of the image forming units 30, the connection of the driving unit 50 and the image forming units 30 becomes the released state. Hence, it is possible to smoothly perform the replacement operation of the image forming units 30.

In particular, in the image forming apparatus 100 of the present embodiment, when the opening operation of the front cover 11 is performed, a transition from the coupled state between the image forming units 30 and the driving unit 50 to the released state between the image forming units 30 and the driving unit 50 is performed in conjunction with the opening operation of the front cover 11. Even if the a user opens the front cover 11 and attempts to pull out the image forming units 30 from the inside of the casing 10, the driving force transmission unit 60 connecting the image forming units 30 and the driving unit 50 and members in the vicinity thereof do not break. On the other hand, when the closing operation of the front cover 11 is performed, the released state is maintained. That is, even if a part of the image forming units 30 are lifted up so as to be separated from the transfer belt 4A by the lifter 81, the driving force transmission unit 60 does not move to the coupled position when the user closes the front cover 11. Therefore, it is possible to avoid occurrence of an unintended collision between the members due to the movement of the driving force transmission unit 60.

In the image forming apparatus 100 according to the present embodiment, the image forming units 30Y, 30M and 30C that are not used for the monochrome printing but are used only for the color printing are changed over from the coupled state to the released state in accordance with the opening operation of the front cover 11, while the released state is maintained when the closing operation of the front cover 11 is performed. Specifically, when the opening operation of the front cover 11 is performed, the first slider 71 moves from the position P1 to the position P2 while the contacting portion 713 is in contact with the contacting portion 723, while the first slider stays at the position P2 so that the contact portion 713 moves away from the contacting portion 723, when the closing operation of the front cover 11 is performed. On the other hand, the image forming unit 30K that is used for both of the monochrome printing and the color printing is changed over from the coupled state to the released state in accordance with the opening operation of the front cover 11, while the image forming unit 30K is changed over from the released state to the coupled state in accordance with the closing operation of the front cover 11. That is, when the opening operation of the front cover 11 is performed, the second slider 72 moves to the position P4 to the position P5 while the protrusion portion 724 is engaged with the concave portion 141, and when the closing operation of the front cover 11 is performed, the second slider 72 moves from the position P5 to the position P4 while the protrusion portion 724 is engaged with the concave portion 141.

Therefore, the image forming apparatus 100 can quickly deal with both of the monochrome printing and the color printing. Since the black toner is used for both of the monochrome printing and the color printing, when switching between the monochrome printing mode and the color printing mode, a coupling operation in which the drum drive coupler 61K and the developing drive coupler 62K are coupled with the image forming unit 30K and a separating operation in which the drum drive coupler 61K and the developing drive coupler 62K are separated from the image forming unit 30K do not need to be performed.

In the image forming apparatus 100, for example, in the mode III illustrated in FIG. 8 and FIG. 10B, a part of the first slider 71 at the position P2 and a part of the second slider 72 at the position P4 overlap each other. Therefore, it is possible to make the movement distance of the first slider 71 and the second slider 72 longer while shortening the distance between the adjacent drum drive coupler 61C and the drum drive coupler 61K and the distance between the developing drive coupler 62C and the developing drive coupler 62K. As a result, the movement distance of the drum drive couplers 61 and the developing drive couplers 62 with respect to the image forming units 30 can be increased while keeping a gently inclination angle of the inclined surface 732, the inclined surface 742, the inclined surface 752 and the inclined surface 762. Therefore, it is possible to smoothly attach and detach the drum drive couplers 61 and the developing drive coupler 62 with respect to the image forming units 30 while overall dimensions of the image forming apparatus 100 can be kept small.

(2) Second Embodiment

In the first embodiment, the image forming apparatus 100 in which the movable unit 70 includes two sliders has been described. On the other hand, in a second embodiment, a case where the movable unit 70 includes a slider 91 provided in common for all of the image forming units 30Y, 30M, 30C and 30K will be described.

Figure 13:
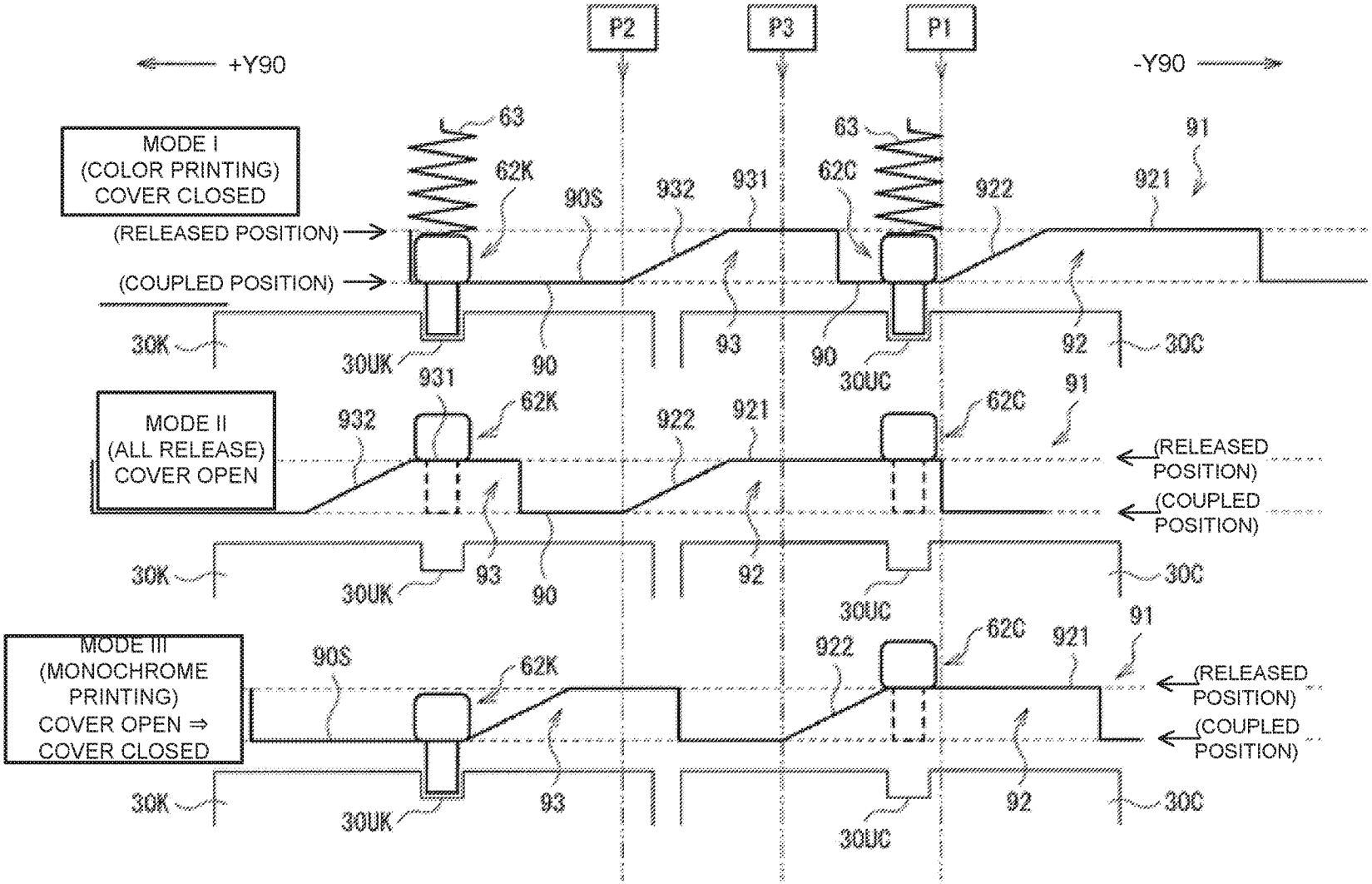
FIG. 13 is a schematic cross-sectional view illustrating the positional relationship between the driving force transmission unit and the movable unit in the image forming apparatus according to a second embodiment.

As described in FIG. 13, the slider 91 is reversibly provided to be able to move in a +Y90 direction and Y90 direction, between the position P1 and the position P3. The slider 91 includes, for example, guide walls 92 corresponding to the guide walls 74 of the first slider 71 according to the first embodiment and a guide wall 93 corresponding to the guide wall 76 of the second slider 72 according to the first embodiment. The guide walls 92 includes, for example, upper end surfaces 921 and inclined surfaces 922 in contact with the developing drive couplers 62Y, 62M and 62C of the image forming units 30Y, 30M and 30C. The guide wall 93 includes, for example, an upper end surface 931 and an inclined surface 932 in contact with the developing drive coupler 62K of the image forming unit 30K. In FIG. 13, the developing drive coupler 62C among the developing drive couplers 62Y, and 62M and 62C is illustrated.

In the mode I, both of the drum drive couplers 61 and the developing drive couplers 62 are at the coupled position. Specifically, in the mode I, the slider 91 is at the position P1, and the head portions 622 urged by the urging members 63 are in contact with the upper surface 90S of the plate-shaped member 710. Hence the neck portions 621 penetrate the openings of the plate-shaped member 90 and project to the opposite to the upper surface 90S of the plate-shaped member 90. The tips of the projected neck portion 621 are engaged with the concave portions 30U. In FIG. 13, the tip of the neck portion 621 of the developing drive coupler 62C is engaged with the concave portion 30UC of the image forming unit 30C, and the tip of the neck portion 621 of the developing drive coupler 62K is engaged with the concave portion 30UK of the image forming unit 30K.

In mode II, the drum drive couplers 61 and the developing drive couplers 62 are all at the released position. In the released position, the drum drive couplers 61 and the developing drive couplers 62 are separated from the image forming units 30Y, 30M, 30C and 30K, and the driving force from the ID motor 53 is not transmitted to the image forming units 30. Specifically, in the mode II, the slider 91 is at the position P2, and the head portions 622 urged by the urging members 63 are in contact with each of the upper end surface 921 of the guide walls 92 and the upper end surface 931 of the guide wall 93. Therefore, in the mode II, the tips of the neck portions 621 retract to the height position substantially equal to the upper surface 90S of the plate-shaped member 90 or the front side from the upper surface 90S, and therefore the neck portions 621 are hidden by the guide walls 92 and the guide wall 93. The tips of the retracted neck portions 621 are separated from the concave portions 30U. FIG. 13 is illustrated an appearance in which the tip of the neck portion 621 of the developing drive coupler 62C is separated from the concave portion 30UC of the image forming unit 30C and the tip of the neck portion 621 of the developing drive coupler 62K is separated from the concave portion 30UK.

In the mode III, the drum drive coupler 61K and the developing drive coupler 62K corresponding to the image forming unit 30K are all at the released position. On the other hand, the drum drive couplers 61Y, 61M and 61C and the developing drive couplers 62Y, 62M and 62C corresponding to the image forming units 30Y, 30M and 30C are at the released position. Specifically, in mode III, the slider 91 is at the position P3 between the position P1 and the position P2. In the position P3, the head portion 622 of the developing drive coupler 62K is in contact with the upper surface 90S, and the neck portion 621 of the developing drive coupler 62K is engaged with the concave portion 30UK of the image forming unit 30K. On the other hand, the head portion 622 of the developing drive coupler 62C is kept in contact with the upper end surface 921, and therefore the neck portion 621 of the developing drive coupler 62C is separated from the concave portion 30UC of the image forming unit 30C.

The neck portion 621 of the developing drive coupler 62K is engaged with the concave portion 30UK, while the neck portion 621 of the developing drive coupler 62C is separated from the concave portion 30UC because the length of the upper end surface 931 and the length of the upper end surface 921 in the movement direction of the slider 91 are different from each other. That is, the length of the upper end surface 921 is longer than the length of the upper end surface 931, and therefore when the slider 91 moves from the position P2 to the position P3, the head portion 622 of the developing drive coupler 62K reaches the upper surface 90S via the inclined surface 932 from the upper end surface 931, while the head portion 622 of the developing drive coupler 62C stays at the upper end face 921.

Figure 14:
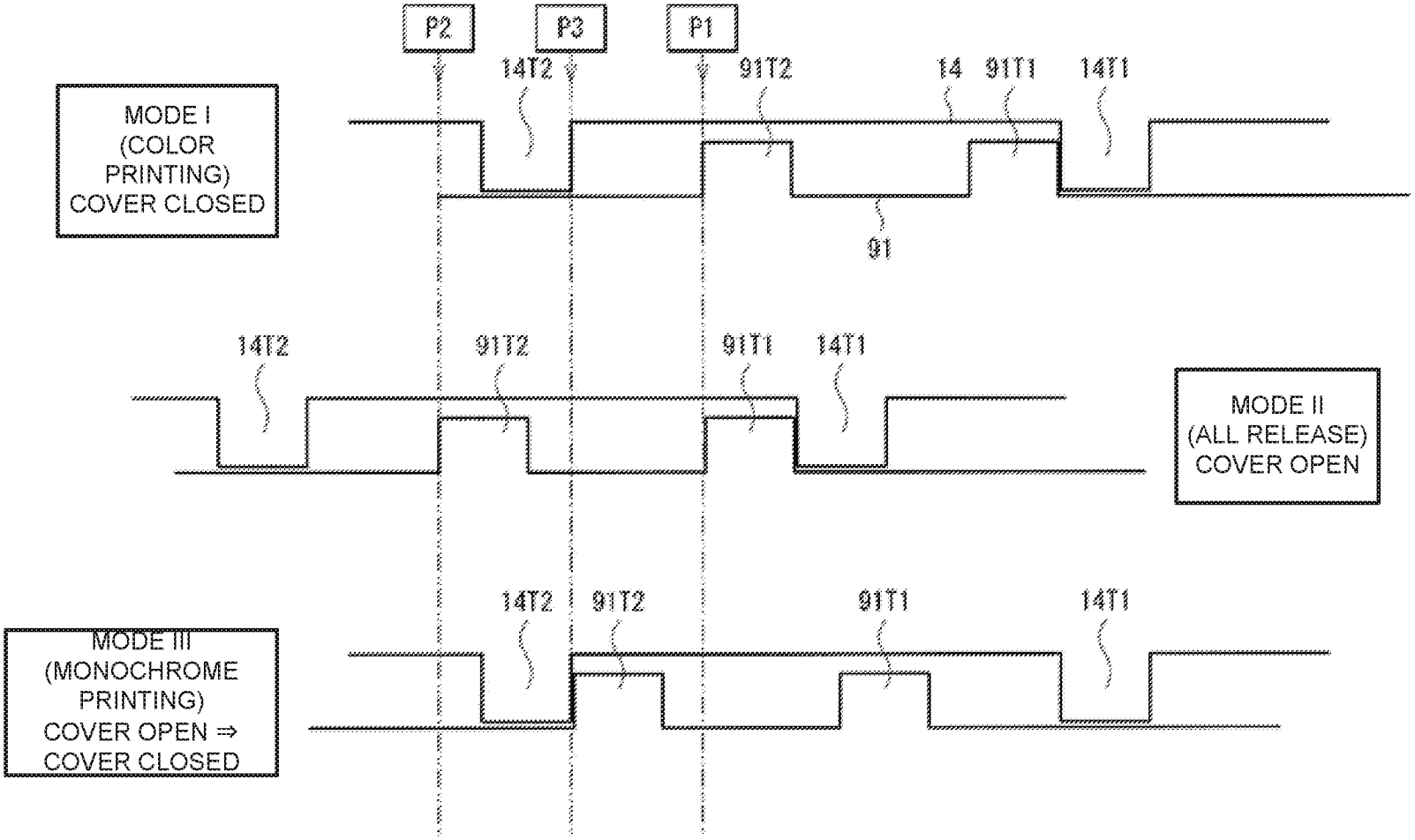
FIG. 14 is schematic diagram illustrating the positional relationship between a front cover and a slider in the image forming apparatus illustrated in FIG. 13.

The transition operation from the mode I to mode II and the transition operation from the mode II to the mode III can be realized, for example, by the schematically configuration illustrated in FIG. 14. FIG. 14 is schematic diagram illustrating the positional relationship along the movement direction of the slider 91, between the connecting member 14 (FIG. 6) in the front cover 11 and the slider 91. As illustrated in FIG. 14, the slider 91 includes an engaging portion 91T1 as "first slider engaging portion" in the technology arranged in the movement direction of the slider 91 (the left and right direction on the drawings sheet of FIG. 14) and an engaging portion 91T2 as "second slider engaging portion" in the technology. On the other hand, the connecting member 14 includes an engaging portion 14T1 as "first operation engaging portion" in the technology and an engaging portion 14T2 as "second operation engaging portion" in the technology. The engaging portion 14T1 and the engaging portion 14T2 are provided so as to sandwich the engaging portion 91T1 and the engaging portion 91T2 between the engaging portion 14T1 and the engaging portion 14T2 in the movement direction of the slider 91. By the above configuration, in the image forming apparatus 100 according to the second embodiment, when the opening operation of the front cover 11 is performed, the engaging portion 91T1 is separated from the engaging portion 14T1, and the engaging portion 91T2 is engaging with the engaging portion 14T2. The engaging portion 14T1 and the engaging portion 14T2 may be arranged to be sandwiched between the engaging portion 91T1 and the engaging portion 91T2.

When the opening operation of the front cover 11 is performed, the slider 91 moves from the position P1 to the position P2 in a state where the engaging portion 91T2 is separated from the engaging portion 14T2 while maintaining a state where the engaging portion 91T1 is engaged with the engaging portion 14T1. That is, the transition from the mode I to the mode II is completed in association with the opening operation of the front cover 11. Further, when the closing operation of the front cover 11 is performed, the slider 91 moves from the position P2 to the position P3 while maintaining the state where the engaging portion 91T1 is separated from the engaging portion 14T1 and the engaging portion 91T2 is engaged with the engaging portion 14T2. That is, the transition from the mode II to the mode I is completed in association with the closing operation of the front cover 11.

Even if in the case where the common slider 91 is provided, as in the first embodiment, the mode I, the mode II and the mode III can be realized. Accordingly, the second embodiment can expect the same effect as in the first embodiment. In particular, the second embodiment can reduce the number of parts and the manufacturability is improved as compared to in the case where the first slider and the second slider are separately provided.

(3) Modification Examples

While the technology is explained with several embodiments, the technology is not limited thereto and various modifications are possible. For example, while the image forming apparatus using a toner of four colors is explained in the above embodiment, the technology is not limited thereto and may be applied to an image forming apparatus that performs printing operation by using a toner of three colors or less, or a toner of five colors or less. Further, the image forming apparatus 100 in a direct transfer type is explained in the above embodiment, the present technology may be applied to an image forming apparatus in a secondary transfer type.

Moreover, the series of processes that have been described above in the foregoing example embodiments may be performed by means of hardware (a circuit), or may be performed by means of software (a program). In the case where the series of processes are performed by means of the software, the software may include a group of programs directed to executing each function by a computer. Each of the programs may be provided to the foregoing computer beforehand, or may be installed on the foregoing computer from a network or a non-transitory recording medium, for example.

While the LED head having a light emitting diode is used as an exposure device that is a light source in the above embodiment, the light source may be, for example, a laser element or the like.

While, in the above embodiment, the image forming apparatus having print function is explained as a specific example of the "image forming apparatus" of the technology, the technology is not limited thereto. Specifically, the technology may be applied to an image forming apparatus that serves as a multifunction machine having, in addition to such print function, for example, scan function or FAX function.

The invention claimed is:

1. An image forming apparatus comprising:

an image forming section that includes one or more image forming units;

a driving unit that generates driving force;

an operation unit that selectively performs a first operation and a second operation, the operation unit including an opening and closing member; and in a casing that is provided with the opening and closing member and accommodates the image forming section, wherein the first operation is an operation of opening the opening and closing member with respect to the casing to change over from a coupled state to a released state of the one or more image forming units and the driving unit wherein the driving force from the driving unit is transmitted to the one or more image forming units in the coupled state, and the driving force from the driving unit is not transmitted to any of the one or more image forming units in the released state, the second operation is an operation of closing the opening and closing member with respect to the casing with the released state maintained, the image forming apparatus further includes a slider that moves from a first position to a second position by the first operation and remains at the second position when the second operation is performed, or moves from the second position to a third position by the second operation while maintaining the released state, and a coupler that is at a coupled position when the slider is at the first position in the coupled state, and that is at a released position when the slider is at the second position in the released state, the slider includes a first contacting portion and a guide portion, the operation unit includes a second contacting portion that is in contact with the first contacting portion, when the first operation is performed, the slider moves from the first position to the second position while maintaining in a state where the second contacting portion is in contact with the first contacting portion, when the second operation is performed, the second contacting portion is separated from the first contacting portion and the slider either remains at the second position, or moves from the second position to the third position, the guide portion of the slider includes a coupled position holding portion that holds the coupler at the coupled position when the slider is at the first position, a released position holding portion that holds the coupler at the released position when the slider is at the second position, and that protrudes from the coupled position holding portion to a side opposite of the image forming section, and an inclined portion that connects the coupled position holding portion and the released position holding portion.

2. The image forming apparatus of claim 1, wherein the image forming section includes a first image forming unit and a second image forming unit, the slider is a common slider the coupler is a first coupler and further includes a second coupler, when the common slider is at the first position or the third position, the second coupler is coupled with both of the second image forming unit and the driving unit and is at another coupled position to transmit the driving force to the second image forming unit, when the common slider is at the second position, the second coupler is separated from at least one of the second image forming unit and the driving unit and is at another released position at which the driving force is not transmitted to the second image forming unit.

3. The image forming apparatus of claim 2, wherein the common slider includes the first contacting portion and a third contacting portion arranged along a first direction, the operation unit is provided so as to sandwich the first contacting portion and third contacting portion in the first direction, or the operation unit includes the second contacting portion and a fourth contacting portion provided so as to be sandwiched between the first contacting portion and the third contacting portion in the first direction, when the first operation is performed, the common slider moves from the first position to the second position in a state where the third contacting portion separates from the fourth contacting portion while maintaining in a state where the first contacting portion is engaged with the second contacting portion, and when the second operation is performed, the common slider moves from the second position to the third position while the first contacting portion separates from the second contacting portion and maintaining in a state where the third contacting portion is engaged with the fourth contacting portion.

4. The image forming apparatus of claim 3, wherein when the second operation is performed, the third contacting portion is engaged with the fourth contacting portion after the first contacting portion separates from the second contacting portion.

5. The image forming apparatus of claim 2, wherein the guide portion is a first guide portion and further includes a second guide portion, the first guide portion guides the first coupler from the coupled position to the released position by moving the common slider from the first position to the second position, the second guide portion guides the second coupler from the another coupled position to the another released position by moving the common slider from the first position to the second position, and guiding the second coupler from the another released position to the another coupled position by moving the common slider from the second position to the third position.

6. The image forming apparatus of claim 1, wherein the image forming section includes a first image forming unit and a second image forming unit, the slider is a first slider, and further includes a second slider that moves from a fourth position to a fifth position by the first operation and moves from the fifth position to the fourth position by the second operation, the coupler is a first coupler, and further includes a second coupler, when the second slider is at the fourth position, the second coupler is coupled with both of the second image forming unit and the driving unit and is at another coupled position to transmit the driving force to the second image forming unit, and when the second slider is at the fifth position, the second coupler is separated from at least one of the second image forming unit and the driving unit and is at another released position to not be transmitted the driving force to the second image forming unit.

7. The image forming apparatus of claim 6, wherein at least a part of the first slider at the second position overlaps with at least a part of the second slider at the fourth position.

8. The image forming apparatus of claim 6, wherein the second slider includes a third contacting portion, when the first operation is performed, the first slider moves from the first position to the second position while the first contacting portion is in contact with the third contacting portion, and when the second operation is performed, the first slider remains at the second position such that the first contacting portion separates from the third contacting portion.

9. The image forming apparatus of claim 6, wherein the first slider includes a first guide portion that guides the first coupler from the coupled position to the released position by moving the first slider from the first position to the second position, and the second slider includes a second guide portion that guides the second coupler from the another coupled position to the another released position by moving the second slider from the fourth position to the fifth position.

10. The image forming apparatus of claim 1, wherein the image forming section includes a developing roller that supports a developer on its surface, and an photosensitive drum that supports a developer image on its surface, the coupler includes a developing drive coupler that drives the developing roller, and a drum drive coupler that drives the photosensitive drum, and the guide portion includes a guide wall that guides the developing drive coupler, and another guide wall that guides the drum drive coupler.

11. An image forming apparatus comprising:

an image forming section that includes one or more image forming units;

a driving unit that generates driving force;

an operation unit that selectively performs a first operation and a second operation, the operation unit including an opening and closing member; and a casing that is provided with the opening and closing member and accommodates the image forming section, wherein the first operation is an operation of opening the opening and closing member with respect to the casing to change from a coupled state to a released state, and the second operation is an operation of closing the opening and closing member with respect to the casing to remain in the releases state, the coupled state is a state in which the one or more image forming units are coupled to the driving unit such that the driving force from the driving unit is transmitted to the one or more image forming units, and the released state is a state in which the one or more image forming units are not coupled to the driving unit such that the driving force from the driving unit is not transmitted to the one or more image forming units the image forming apparatus further includes a slider that moves from a first position to a second position by the first operation and remains at the second position when the second operation is performed, and a coupler that is in the coupled state when the slider is at the first position, and that is in the released state when the slider is at the second position, the coupler being at a coupled position when in the coupled state, and being at a released position when in the released state, the slider includes a first contacting portion and a guide portion, the operation unit includes a second contacting portion that is in contact with the first contacting portion, when the first operation is performed, the slider moves from the first position to the second position while maintaining in a state where the second contacting portion is in contact with the first contacting portion, and when the second operation is performed, the second contacting portion is separated from the first contacting portion and the slider remains at the second position, the guide portion of the slider includes a coupled position holding portion that holds the coupler at the coupled position when the slider is at the first position, a released position holding portion that holds the coupler at the released position when the slider is at the second position, and that protrudes from the coupled position holding portion to a side opposite of the image forming section, and an inclined portion that connects the coupled position holding portion and the released position holding portion.

* * * * *